US011097918B2

(12) United States Patent
Kiriyama

(10) Patent No.: US 11,097,918 B2
(45) Date of Patent: Aug. 24, 2021

(54) FINISHER, NON-TRANSITORY COMPUTER-READABLE RECORDING MEDIUM AND METHOD FOR CONTROLLING TRANSPORTATION OF MEDIA SHEETS

(71) Applicant: KONICA MINOLTA, INC., Tokyo (JP)

(72) Inventor: Tomohiro Kiriyama, Kofu (JP)

(73) Assignee: KONICA MINOLTA, INC., Tokyo (JP)

( * ) Notice: Subject to any disclaimer, the term of this patent is extended or adjusted under 35 U.S.C. 154(b) by 223 days.

(21) Appl. No.: 16/433,002

(22) Filed: Jun. 6, 2019

(65) Prior Publication Data

US 2019/0382229 A1 Dec. 19, 2019

(30) Foreign Application Priority Data

Jun. 13, 2018 (JP) ..... JP2018-112414

(51) Int. Cl.

| | |
|---|---|
| ***B65H 39/02*** | (2006.01) |
| ***B65H 35/00*** | (2006.01) |
| ***B65H 5/26*** | (2006.01) |
| ***B65H 35/06*** | (2006.01) |

(52) U.S. Cl.

CPC ..... *B65H 35/0086* (2013.01); *B65H 5/26* (2013.01); *B65H 35/06* (2013.01); *B65H 39/02* (2013.01)

(58) Field of Classification Search

CPC ..... B65H 35/086; B65H 39/02; B65H 5/26; B65H 35/06; B65H 43/00; B65H 5/00; G03G 15/655; G03G 15/6538; G03G 15/6555

See application file for complete search history.

(56) References Cited

U.S. PATENT DOCUMENTS

| | | | | |
|---|---|---|---|---|
| 6,364,305 | B1 * | 4/2002 | Sussmeier | B65H 3/10 270/52.09 |
| 7,561,844 | B2 | 7/2009 | Ishizuka | |
| 8,746,671 | B2 * | 6/2014 | Machida | B65H 3/44 271/9.02 |
| 9,885,994 | B2 * | 2/2018 | Asakawa | B65H 1/00 |

(Continued)

FOREIGN PATENT DOCUMENTS

| | | | |
|---|---|---|---|
| JP | 2005350215 | A | 12/2005 |
| JP | 2007079051 | A | 3/2007 |

*Primary Examiner* — Patrick H Mackey

(74) *Attorney, Agent, or Firm* — Holtz, Holtz & Volek PC

(57) ABSTRACT

Provided are a finisher, a non-transitory computer-readable recording medium and a method for controlling transportation of media sheets. The finisher includes a sheet transporter, a sheet cutter for dividing each printed media sheet into multiple cut media sheets by cutting, a sheet inserter that inserts insertion sheets into the sheet path, a sheet stacker for stacking the cut media sheets and the insertion sheets transported by the sheet transporter, a sheet buffer disposed on a branch line branching off from the sheet path, and a controller. The controller sets a sheet insertion mode to a pre-sheet insertion mode or a post-sheet insertion mode, and causes the sheet transporter to transport a part of cut media sheets or an insertion sheet into the sheet buffer and change the order of the sheets in the sheet path so that the insertion sheet is positioned between the cut media sheets.

21 Claims, 22 Drawing Sheets

(56) References Cited

U.S. PATENT DOCUMENTS

| | | | | |
|---|---|---|---|---|
| 2012/0286469 | A1* | 11/2012 | Sato | B65H 31/02<br>271/265.01 |
| 2018/0345693 | A1* | 12/2018 | Prinsen | B65H 31/24 |
| 2019/0233242 | A1* | 8/2019 | Wakabayashi | B65H 33/04 |
| 2019/0310578 | A1* | 10/2019 | Wagatsuma | B65H 37/06 |

* cited by examiner

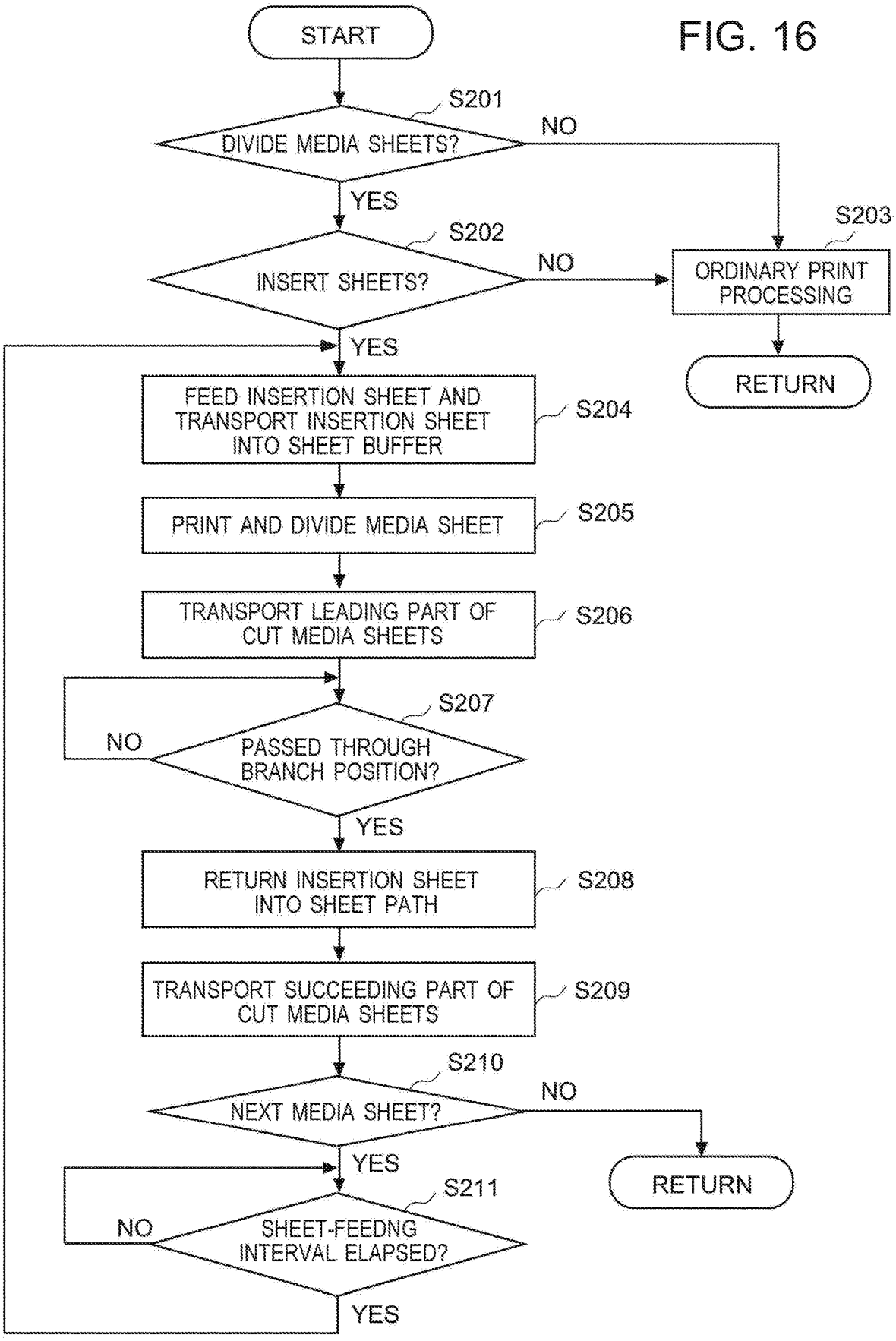
START
FIG. 16
S201
DIVIDE MEDIA SHEETS?
NO
YES
S202
INSERT SHEETS?
NO
S203
ORDINARY PRINT PROCESSING
RETURN
YES
FEED INSERTION SHEET AND TRANSPORT INSERTION SHEET INTO SHEET BUFFER
S204
PRINT AND DIVIDE MEDIA SHEET
S205
TRANSPORT LEADING PART OF CUT MEDIA SHEETS
S206
S207
NO
PASSED THROUGH BRANCH POSITION?
YES
RETURN INSERTION SHEET INTO SHEET PATH
S208
TRANSPORT SUCCEEDING PART OF CUT MEDIA SHEETS
S209
S210
NEXT MEDIA SHEET?
NO
RETURN
YES
S211
NO
SHEET-FEEDNG INTERVAL ELAPSED?
YES

FINISHER, NON-TRANSITORY COMPUTER-READABLE RECORDING MEDIUM AND METHOD FOR CONTROLLING TRANSPORTATION OF MEDIA SHEETS

Japanese Patent Application No. 2018-112414 filed on Jun. 13, 2018, including description, claims, drawings, and abstract, the entire disclosure of which is incorporated herein by reference in its entirety.

TECHNOLOGICAL FIELD

The present invention is directed to finishers, non-transitory computer-readable recording media each storing a program for controlling transportation of media sheets, and methods for controlling transportation of media sheets. In particular, the present invention is directed to finishers capable of putting an insertion sheet between cut media sheets given by a division of a media sheet by cutting, non-transitory computer-readable recording media each storing a program for controlling transportation of media sheets, to be executed in the finisher, and methods for controlling transportation of media sheets.

BACKGROUND

Some of recent printing devices like MFPs (multi-functional peripherals) are equipped with an imposition function that arranges and prints multiple pages per sheet of print media, and a cutting function that cuts sheets of print media so as to divide each sheet into multiple small-size sheets. To save printing cost, there have been proposed techniques to, by using such a printing device, print two pages per sheet of print media and then cut each printed sheets into halves, rather than printing pages on sheets of print media one page by one page.

As an example of the techniques to divide media sheets by cutting, Japanese Unexamined Patent Publication (JP-A) No. 2007-079051 discloses the following technique about a cutting device for cutting sheets of recording material on each of which multiple images were formed, into desired-size pieces. After cutting each printed sheet of the recording material into multiple pieces, the cutting device outputs a piece or pieces on each of which an image was formed, and keeps the remaining blank piece or pieces into a certain space in the cutting device.

As another example, JP-A No. 2005-350215 discloses the following image forming apparatus. The image forming apparatus includes a sheet supply storing a stack of media sheets, a feeder and a printing unit, where the printing unit receives media sheets fed by the feeder from the sheet supply one sheet by one sheet, and then performs predetermined image-forming processing on the received media sheets. The image forming apparatus further incudes a sheet transportation path for transporting media sheets to the printing unit, disposed between the sheet supply and the printing unit. The sheet transportation path includes a first transportation path, a second transportation path, and a path switch for switching the path to be used for transporting media sheets, to one of the first transportation path or the second transportation path. On the second transportation path, a sheet cutter, a cut sheet container and a cut sheet feeder are disposed in series. The sheet cutter cuts media sheets fed from the sheet supply, into predetermined-size sheets (cut sheets), and the cut sheet container stores the cut sheets, and the cut sheet feeder feeds the cut sheets stored in the cut sheet container, toward the printing unit.

In processing of dividing media sheets into small-size cut sheets and binding the cut sheets to create a booklet, or in processing of dividing media sheets into small-size cut sheets and making a stack of the cut sheets, a demand for putting insertion sheets loaded on a tray for the insertion sheets, between the cut sheets, may arise. The insertion sheets are media sheets not to be subjected to print processing (media sheets for which there is no need to perform print processing), such as media sheets printed by an external printing device in advance, interleaving sheets or blank sheets, and an insertion sheet is the general term for these sheets. In conventional printing devices, cut media sheets are transported successively along a sheet path, and it was difficult for such printing devices to put insertion sheets between cut media sheets.

SUMMARY

The present invention is directed to finishers, non-transitory computer-readable recording media each storing a program for controlling transportation of media sheets, and methods for controlling transportation of media sheets, which allows an finisher to properly put an insertion sheet fed from a tray for the insertion sheets, between cut media sheets given by a division of each media sheet by cutting.

A finisher reflecting one aspect of the present invention comprises: a sheet transporter that transports media sheets along a sheet path; a sheet cutter that is disposed on the sheet path and that receives printed media sheets that were subjected to print processing by a print engine and divides each of the printed media sheets into two or more cut media sheets that lie in the sheet path, by cutting each of the printed media sheets in a direction crossing the sheet path; a sheet inserter that inserts insertion sheets not to be subjected to print processing, into the sheet path; a sheet stacker that stacks the cut media sheets and the insertion sheets transported by the sheet transporter thereon; a sheet buffer that is disposed on a branch line branching off from the sheet path at a branch position on the sheet path between the sheet cutter and the sheet stacker; and a controller that controls transportation of media sheets with the sheet transporter. The controller performs the following operations. The operations include setting a sheet insertion mode to one of a pre-sheet insertion mode and a post-sheet insertion mode, where the sheet insertion mode is a mode for use in inserting an insertion sheet to be put between cut media sheets given by a division of one of the printed media sheets, into the sheet path by the sheet inserter, the pre-sheet insertion mode is a mode in which the insertion sheet is inserted into the sheet path so that the insertion sheet passes through the sheet cutter before the sheet cutter divides the one of the printed media sheets, and the post-sheet insertion mode is a mode in which the insertion sheet is inserted into the sheet path so that the insertion sheet passes through the sheet cutter after the sheet cutter divides the one of the printed media sheets. The operations further include, according to the sheet insertion mode, controlling transportation of cut media sheets given by a division of one of the printed media sheets with the sheet cutter and an insertion sheet inserted into the sheet path by the sheet inserter, by causing the sheet transporter to transport either of a part of the cut media sheets and the insertion sheet into the sheet buffer and change the order of the cut media sheets and the insertion sheet being transported along the sheet path so that the insertion sheet is positioned between the cut media sheets.

A non-transitory computer-readable recording medium reflecting one aspect of the present invention stores a program for controlling transportation of media sheets, to be executed in a finisher. The finisher includes: a sheet transporter that transports media sheets along a sheet path; a sheet cutter that is disposed on the sheet path and that receives printed media sheets that were subjected to print processing by a print engine and divides each of the printed media sheets into two or more cut media sheets that lie in the sheet path, by cutting each of the printed media sheets in a direction crossing the sheet path; a sheet inserter that inserts insertion sheets not to be subjected to print processing, into the sheet path; a sheet stacker that stacks the cut media sheets and the insertion sheets transported by the sheet transporter thereon; a sheet buffer that is disposed on a branch line branching off from the sheet path at a branch position on the sheet path between the sheet cutter and the sheet stacker; and a controller that controls transportation of media sheets with the sheet transporter. The program comprises instructions which, when executed by the controller, cause the controller to perform the following operations. The operations comprise setting a sheet insertion mode to one of a pre-sheet insertion mode and a post-sheet insertion mode, where the sheet insertion mode is a mode for use in inserting an insertion sheet to be put between cut media sheets given by a division of one of the printed media sheets, into the sheet path by the sheet inserter, the pre-sheet insertion mode is a mode in which the insertion sheet is inserted into the sheet path so that the insertion sheet passes through the sheet cutter before the sheet cutter divides the one of the printed media sheets, and the post-sheet insertion mode is a mode in which the insertion sheet is inserted into the sheet path so that the insertion sheet passes through the sheet cutter after the sheet cutter divides the one of the printed media sheets. The operations further comprise, according to the sheet insertion mode, controlling transportation of cut media sheets given by a division of one of the printed media sheets with the sheet cutter and an insertion sheet inserted into the sheet path by the sheet inserter, by causing the sheet transporter to transport either of a part of the cut media sheets and the insertion sheet into the sheet buffer and change the order of the cut media sheets and the insertion sheet being transported along the sheet path so that the insertion sheet is positioned between the cut media sheets.

A method reflecting one aspect of the present invention is a method for controlling transportation of media sheets, for use in a finisher. The finisher includes: a sheet transporter that transports media sheets along a sheet path; a sheet cutter that is disposed on the sheet path and that receives printed media sheets that were subjected to print processing by a print engine and divides each of the printed media sheets into two or more cut media sheets that lie in the sheet path, by cutting each of the printed media sheets in a direction crossing the sheet path; a sheet inserter that inserts insertion sheets not to be subjected to print processing, into the sheet path; a sheet stacker that stacks the cut media sheets and the insertion sheets transported by the sheet transporter thereon; a sheet buffer that is disposed on a branch line branching off from the sheet path at a branch position on the sheet path between the sheet cutter and the sheet stacker; and a controller that controls transportation of media sheets with the sheet transporter. The method comprises setting, by the controller, a sheet insertion mode to one of a pre-sheet insertion mode and a post-sheet insertion mode, where the sheet insertion mode is a mode for use in inserting an insertion sheet to be put between cut media sheets given by a division of one of the printed media sheets, into the sheet path by the sheet inserter, the pre-sheet insertion mode is a mode in which the insertion sheet is inserted into the sheet path so that the insertion sheet passes through the sheet cutter before the sheet cutter divides the one of the printed media sheets, and the post-sheet insertion mode is a mode in which the insertion sheet is inserted into the sheet path so that the insertion sheet passes through the sheet cutter after the sheet cutter divides the one of the printed media sheets. The method further comprises, according to the sheet insertion mode, controlling, by the controller, transportation of cut media sheets given by a division of one of the printed media sheets with the sheet cutter and an insertion sheet inserted into the sheet path by the sheet inserter, by causing the sheet transporter to transport either of a part of the cut media sheets and the insertion sheet into the sheet buffer and change the order of the cut media sheets and the insertion sheet being transported along the sheet path so that the insertion sheet is positioned between the cut media sheets.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention, wherein:

FIG. 16 is a flowchart illustrating an example of operations (control of print processing and media sheet transportation in the pre-sheet insertion mode) of the printing device, according to the present embodiment;

DETAILED DESCRIPTION OF EMBODIMENTS

Figure 1:
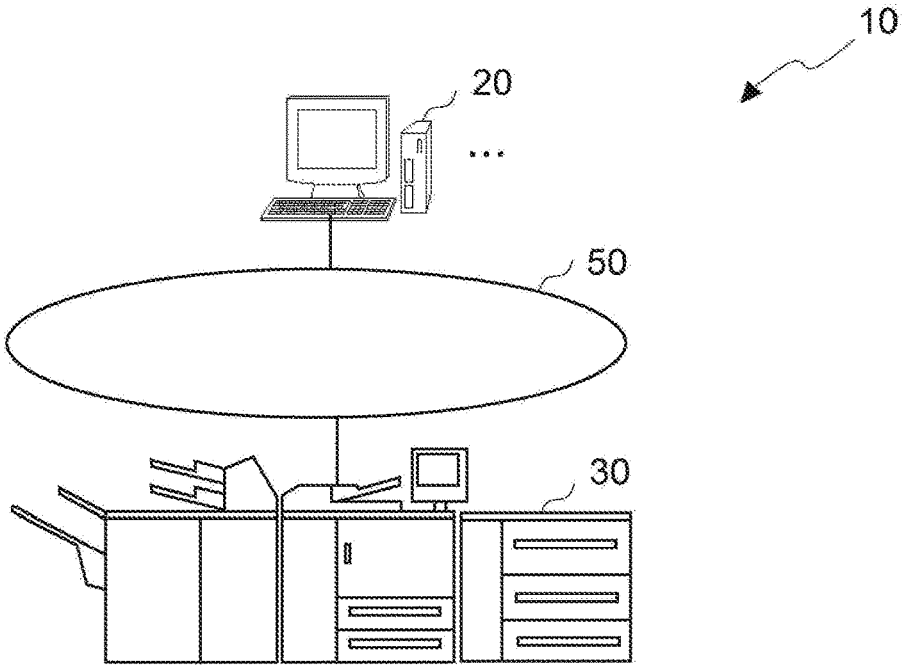
FIG. 1 is a schematic diagram illustrating an example of the constitution of a printing system according to an embodiment of the present invention.

Hereinafter, one or more embodiments of the present invention will be described with reference to the drawings. However, the scope of the invention is not limited to the illustrated embodiments.

As indicated in BACKGROUND, to save printing cost, there have been proposed techniques to print two pages per media sheet and then cut each of the printed media sheets into halves, rather than printing pages on media sheets of print media one page by one page. In processing of dividing media sheets into small-size cut sheets and binding the cut sheets to create a booklet, or in processing of dividing media sheets into small-size cut sheets and making a stack of the cut sheets, a demand for putting insertion sheets loaded on a tray for the insertion sheets, between the cut sheets, may arise. The insertion sheets are media sheets to be subjected to no print processing. Examples of the insertion sheets include media sheets printed by an external printing device in advance, interleaving sheets and blank sheets, and an insertion sheet is the general term for these sheets. In conventional printing devices, cut media sheets are transported successively along a sheet path, and it was difficult for the printing devices to put insertion sheets between cut media sheets.

In view of that, the following device, like a finisher, capable of dividing a media sheet into multiple cut media sheets by cutting and of putting an insertion sheet between the cut media sheets, is provided as one embodiment of the present embodiment. The device (finisher) includes a sheet transporter that transports media sheets along a sheet path, a sheet cutter, a sheet inserter, a sheet stacker, a sheet buffer and a controller. The sheet cutter is disposed on the sheet path so as to receive printed media sheets that were subjected to print processing by a print engine and divide each of the printed media sheets into two or more cut media sheets that lie in the sheet path, by cutting each of the printed media sheets in a direction crossing the sheet path (the cross-machine direction). The sheet inserter is disposed along the sheet path so as to insert insertion sheets not to be subjected to print processing (media sheets for which there is no need to perform print processing), into the sheet path, where examples of the insertion sheets include media sheets printed by an external printing device in advance, interleaving sheets and blank sheets. The sheet stacker is disposed so as to receive the cut media sheets and the insertion sheets transported by the sheet transporter and stack the received sheets thereon. The sheet buffer is disposed on a branch line branching off from the sheet path at a branch position on the sheet path between the sheet cutter and the sheet stacker. The controller controls transportation of media sheets with the sheet transporter. That is, the controller sets a sheet insertion mode to one of a pre-sheet insertion mode and a post-sheet insertion mode. The sheet insertion mode is a mode for use in inserting an insertion sheet to be put between cut media sheets given by a division of one of the printed media sheets, into the sheet path by the sheet inserter. The pre-sheet insertion mode is a mode in which the insertion sheet is inserted into the sheet path so that the insertion sheet passes through the sheet cutter before the sheet cutter divides the one of the printed media sheets. The post-sheet insertion mode is a mode in which the insertion sheet is inserted into the sheet path so that the insertion sheet passes through the sheet cutter after the sheet cutter divides the one of the printed media sheets. According to the sheet insertion mode, the controller controls the transportation of cut media sheets given by a division of one of the printed media sheets with the sheet cutter and an insertion sheet inserted into the sheet path by the sheet inserter, by causing the sheet transporter to transport either of a part of the cut media sheets and the insertion sheet into the sheet buffer and change the order of the cut media sheets and the insertion sheet being transported along the sheet path so that the insertion sheet is positioned between the cut media sheets. The operations allow the device to sort the sheets in the sheet path so as to place the insertions sheets at desired positions in a series or a stack of the sheets.

The controller may further calculate an interval at which the sheet transporter feeds printed media sheets to the sheet cutter, and cause the sheet transporter to feed the printed media sheets to the sheet cutter at the calculated interval. The interval may be calculated by using a time period necessary for the sheet cutter to cut one of the printed media sheets, a time period necessary for the sheet transporter to transport either of an insertion sheet inserted into the sheet path by the sheet inserter and a part of media sheets given by a division of one of the printed media sheets with the sheet cutter (one or more end cut media sheets positioned at the most downstream position among the cut media sheets), along the sheet path into the sheet buffer, a time period necessary for the sheet transporter to return the either of the insertion sheet and the part of the cut media sheets from the sheet buffer into the sheet path, and an interval of the cut media sheets (an interval at which the sheet transporter transports the cut media sheets).

For example, in a case that the sheet insertion mode is set to the pre-sheet insertion mode, the controller may control the transportation of cut media sheets given by a division of one of the printed media sheets with the sheet cutter and an insertion sheet inserted into the sheet path by the sheet inserter, as follows. That is, the controller may cause the sheet transporter to transport an insertion sheet into the sheet buffer and transpose a leading part of the cut media sheets (one or more leading cut media sheet positioned upstream from or leading the other cut media sheets among the cut media sheets) and the insertion sheet, being transported along the sheet path, so that the insertion sheet is positioned between the cut media sheets. In concrete terms, in a case that the sheet insertion mode is set to the pre-sheet insertion mode, the sheet transporter transports media sheets along the sheet path according to the following steps: First, the sheet transporter puts an insertion sheet from the sheet inserter into the sheet path (at an upstream position from the sheet cutter on the sheet path), and transports the insertion sheet along the sheet path into the sheet buffer to be kept therein; Second, the sheet transporter feeds a media sheet printed by a print engine to the sheet cutter, and the sheet cutter divides the printed media sheet into multiple pieces (cut media sheets) that lie in the sheet path, by cutting the printed media sheet in the cross-machine direction; Third, the sheet transporter transports the leading part of the cut media sheets, along the sheet path toward the sheet stacker (or a post-processing unit); Fourth, the sheet transporter returns the insertion sheet kept in the sheet buffer into the sheet path and transports the insertion sheet along the sheet path toward the sheet stacker (or a post-processing unit), after the leading part of the cut media sheets passes through the branch position on the sheet path where the sheet path branches off and leads to the sheet buffer; and Fifth, the sheet transporter transports a succeeding part of the cut media sheets (one or more cut media sheet downstream of or following the leading part of the cut media sheets among the cut media sheets) along the sheet path toward the sheet stacker (or a post-processing unit).

On the other hand, in a case that the sheet insertion mode is set to the post-sheet insertion mode, the controller may control the transportation of cut media sheets given by a division of one of the printed media sheets with the sheet cutter and an insertion sheet inserted into the sheet path by the sheet inserter, as follows. That is, the controller may cause the sheet transporter to transport an end part of cut the media sheets (one or more end cut media sheet positioned downstream from or following the other cut media sheets among the cut media sheets) into the sheet buffer and transpose the end part of the cut media sheets and the insertion sheet, being transported along the sheet path, so that the insertion sheet is positioned between the cut media sheets. In concrete terms, in a case that the sheet insertion mode is set to the post-sheet insertion mode, the sheet transporter transports media sheets along the sheet path according to the following steps: First, the sheet transporter feeds a media sheet printed by a print engine to the sheet cutter, and the sheet cutter divides the printed media sheet into multiple pieces (cut media sheets) that lie in the sheet path, by cutting the printed media sheet in the cross-machine direction; Second, the sheet transporter transports a leading part of the cut media sheets (one or more cut media sheets upstream of or leading the end part of the cut media sheets), along the sheet path toward the sheet stacker (or a post-processing unit); Third, the sheet transporter transports the end part of the cut media sheets along the sheet path into the sheet buffer to be kept therein; Fourth, the sheet transporter puts an insertion sheet from the sheet inserter into the sheet path (at an upstream position from the sheet cutter on the sheet path), and transports the insertion sheet along the sheet path toward the sheet stacker (or a post-processing unit); and Fifth, the transporter returns the end part of the cut media sheets kept in the sheet buffer into the sheet path and transports the end part of the cut media sheets along the sheet path toward the sheet stacker (or a post-processing unit), after the insertion sheet passes through the branch position on the sheet path where the sheet path branches off and leads to the sheet buffer.

As described above, the device (finisher) according to the present embodiment includes a sheet buffer disposed on a branch line branching off from the sheet path at a branch position downstream of the sheet cutter, and is configured to transport an insertion sheet or a part of cut media sheets given by a division of a media sheet by cutting (one or more end cut media sheets among the cut media sheets), into the sheet buffer. It allows the device to put an insertion sheet between the cut media sheets given by cutting each media sheet, and to sort the cut media sheets and the insertion sheets in desired order. For example, in processing of dividing media sheets into small-size cut media sheets and binding the cut media sheets to create a booklet, it allows the device to create a booklet using insertion sheets with saving operator's time and efforts for handling the insertion sheets. In other words, it allows the device to create a booklet that is similar to a booklet created by operations to print pages on media sheets one page by one page.

Embodiment

Figure 2:
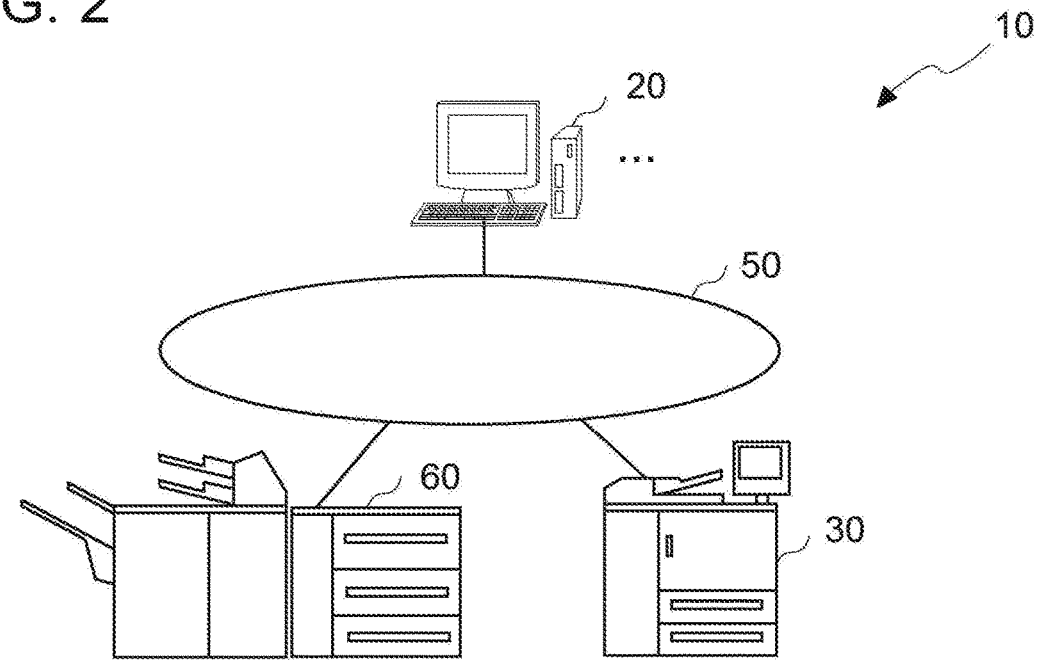
FIG. 2 is a schematic diagram illustrating another example of the constitution of a printing system according to an embodiment of the present invention.
Figure 3A:
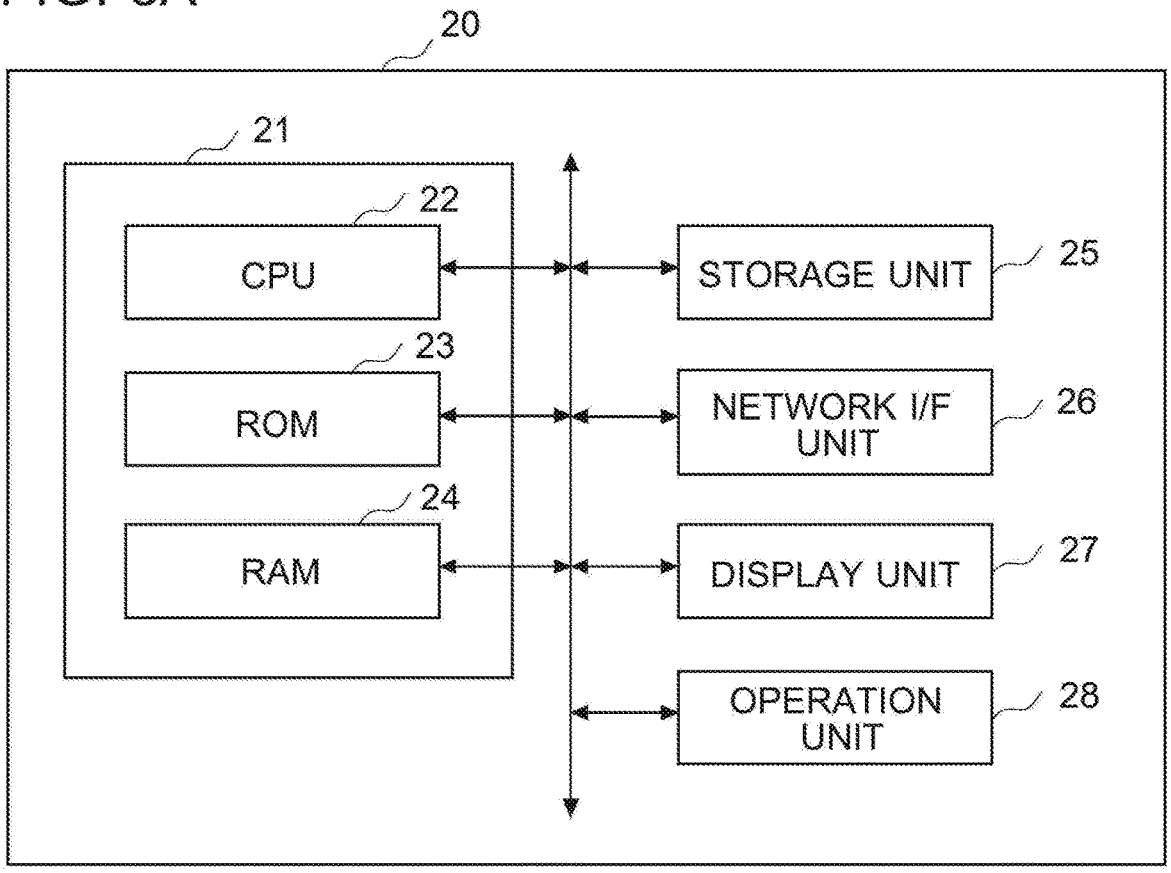
FIGS. 3A and 3B are block diagrams illustrating an example of the constitution of a client terminal according to an embodiment of the present invention.
Figure 3B:
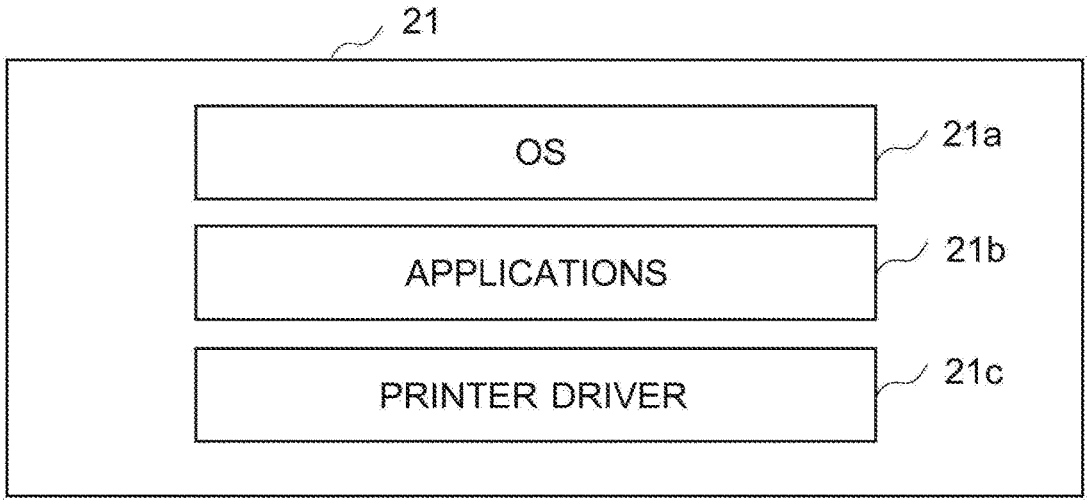
Figure 4:
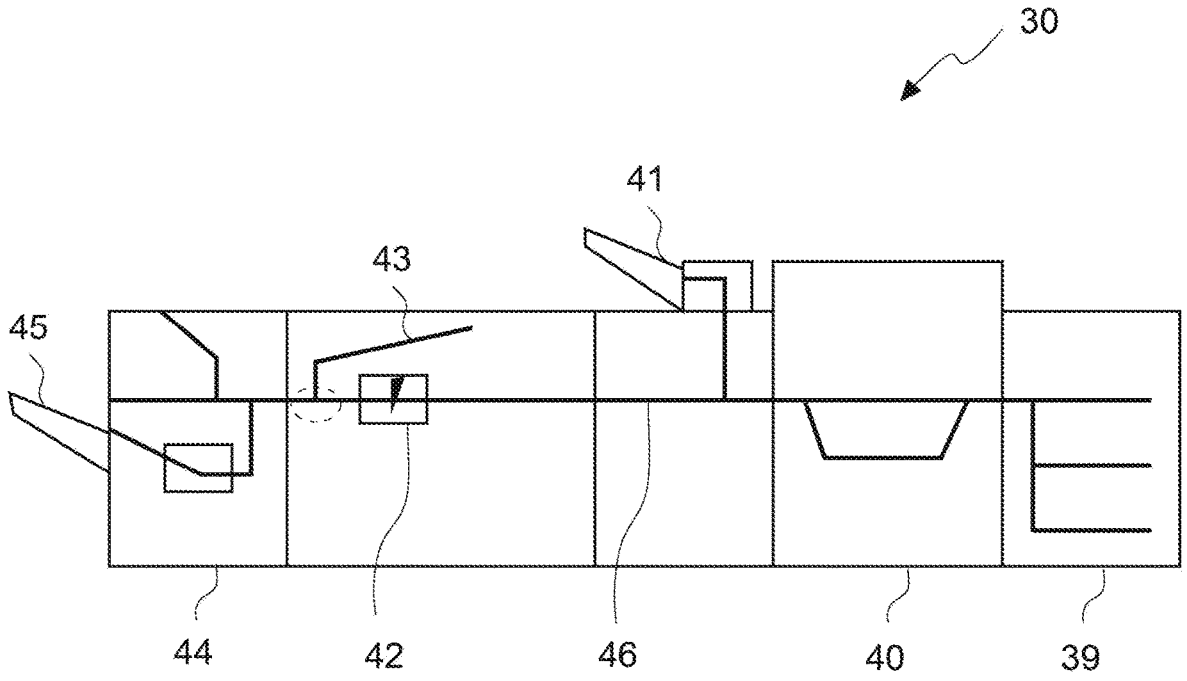
FIG. 4 is a schematic diagram illustrating an example of the constitution of a printing device according to an embodiment of the present invention.
Figure 5A:
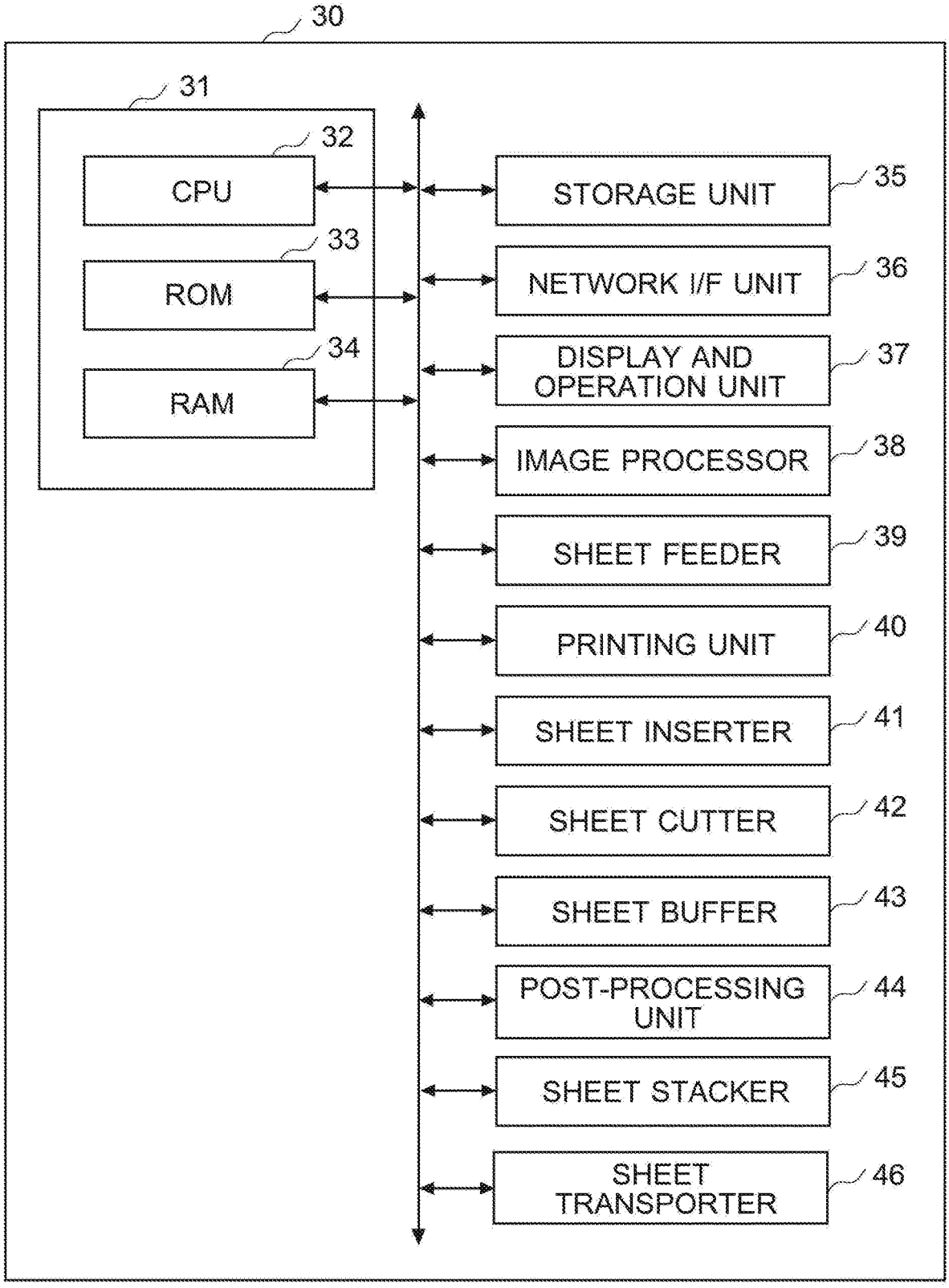
FIGS. 5A is a and 5B are block diagrams illustrating an example of the constitution of the printing device according to an embodiment of the present invention.
Figure 5B:
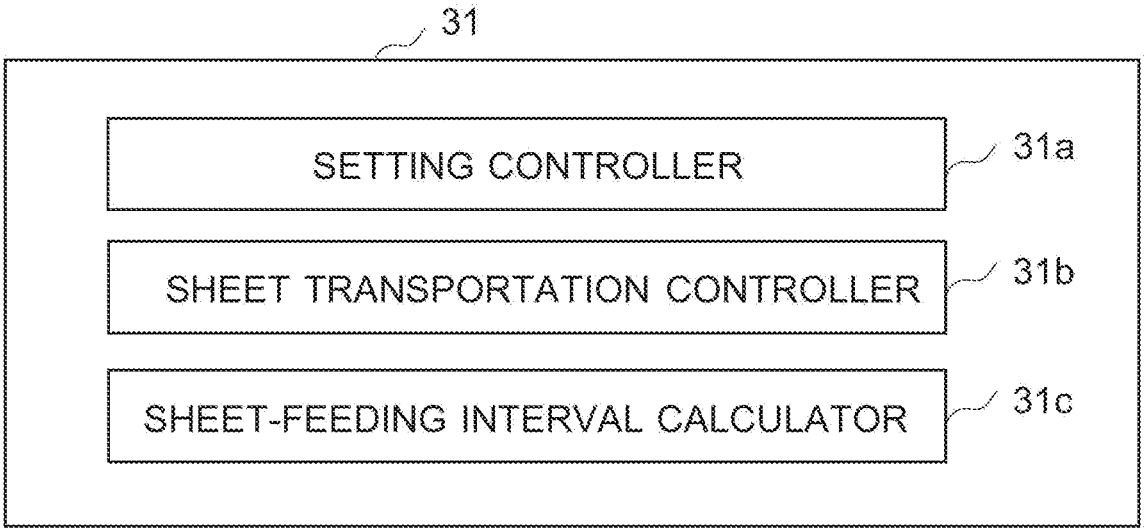

In order to describe an embodiment of the present invention in more in detail, a description is given of a finisher, a non-transitory computer-readable recording medium storing a program for controlling transportation of media sheets, and a method for controlling transportation of media sheets, with reference to FIG. 1 through FIG. 18. FIG. 1 and FIG. 2 each is a schematic diagram illustrating an example of the constitution of a printing system according to the present embodiment. FIGS. 3A and 3B are block diagrams illustrating an example of the constitution of a client terminal according to the present embodiment. FIG. 4 is a schematic diagram illustrating an example of the constitution of a printing device according to the present embodiment. FIGS. 5A and 5B are block diagrams illustrating an example of the constitution of the printing device according to the present embodiment. FIGS. 6A to 6E are diagrams illustrating an example of a basic way to control print processing and transportation of media sheets, in which media sheets are cut into small-size sheets. FIGS. 7A to 7E are diagrams illustrating an example of an ordinary way to control print processing and transportation of media sheets, using insertion sheets to be put between media sheets. FIGS. 8A to 8D are diagrams illustrating a basic idea to control transportation of media sheets so as to put insertion sheets between cut media sheets, according to the present embodiment. FIGS. 9A to 11E are diagrams illustrating an example of a way to control the media sheet transportation in the pre-sheet insertion mode. FIGS. 12A to 14E are diagrams illustrating an example of a way to control the media sheet transportation in the post-sheet insertion mode. FIGS. 15 to 18 are flowcharts illustrating an example of operations of the printing device, according to the present embodiment.

As illustrated in FIG. 1, printing system 10 according to the present embodiment includes at least one client terminal 20 and printing device 30. These apparatuses are communicably connected to each other via communication network 50, where examples of the communication network 50 include a LAN (Local Area Network) and WAN (Wide Area Network) defined by specifications, such as Ethernet, Token Ring and FDDI (Fiber-Distributed Data Interface). Printing system 10 in FIG. 1 employs printing device 30 capable of dividing a media sheets into cut media sheets by cutting, and of putting an insertion sheet between the cut media sheets, but alternatively, printing system 10 may further employ finisher 60 capable of dividing a media sheets into cut media sheets by cutting, and of putting an insertion sheet between the cut media sheets, separately from printing device 30, as illustrated in FIG. 2. Printing system 10 in FIG. 1 includes at least one client terminal 20 and printing device 30, but alternatively, printing system 10 may further include an external controller communicably connected to communication network 50 and communicably connected to printing device 30 with a LAN, a WAN or an exclusive line supporting, for example, PCI (Peripheral Component Interconnect) communication. Hereinafter, a description of each apparatus in printing system 10 is given on the assumption of the constitution of printing system 10 illustrated in FIG. 1.

Client Terminal:

Client terminal 20 is a computing device like a computer or a mobile terminal, where examples of the client terminal 20 include personal computers, tablets and smartphones. Client terminal 20 is configured to send a print job to printing device 30. Client terminal 20 includes, as illustrated in FIG. 3A, built-in controller 21, storage unit 25, network interface (I/F) unit 26, display unit 27 and operation unit 28.

Built-in controller 21 includes CPU (Central Processing Unit) 22 as a hardware processor, and memories including ROM (Read Only Memory) 23 and RAM (Random Access Memory) 24. CPU 22 reads out control programs stored in ROM 23 or storage unit 25, loads the control programs onto RAM 24, and executes the control programs, thereby controlling operations of the components of client terminal 20. As illustrated in FIG. 3B, built-in controller 21 (CPU 22) is configured to execute OS (Operating System) 21*a*, applications 21*b* and printer driver 21*c*.

Examples of OS 21*a* include Microsoft Windows, macOS and Android, where Microsoft and Windows are either registered trademarks or trademarks of Microsoft Corporation in the United States and/or other countries, macOS is a registered trademark or trademark of Apple Inc. in the United States and/or other countries, and Android is a registered trademark or trademark of Google Inc. in the United States and/or other countries. OS 11*a* manages application programs including applications 21*b* and printer driver 21*c* in client terminal 20 so as to function and run the application programs.

Applications 21*b* include, for example, an application program for creating documents, which, on sending print instructions, invokes printer driver 21*c* and transfers data created by one of applications 21*b* to printer driver 21*c* by being executed by CPU 22.

Printer driver 21*c* converts document data created by one of applications 21*b* into a print job in a language that printing device 30 can interpret, and sends the print job to printing device 30, by being executed by CPU 22, where examples of the print job include PDL (Page Description Language) data written in page description languages, such as PJL (Printer Job Language), PS (PostScript) and PCL (Printer Control Language); and PDF (Portable Document Format) data. When being executed, the printer driver 21*c* causes display unit 27 to display a print setting screen, writes print settings (such as the sizes of an original document, the number of pages to be printed, the sizes of media sheets, the number of copies to be printed, settings about a division of media sheets by cutting, settings about a use of insertion sheets, and settings for post-processing, in the present embodiment) specified on the screen into a print ticket, and adds the print ticket to the print job.

Storage unit 25 is a non-transitory computer-readable recording medium including a HDD (Hard Disk Drive) and/or a SSD (Solid State Drive), which stores programs which when being executed causes CPU 22 to control of operations of the components of client terminal 20, document data, a print job, and other data.

Network I/F unit 26 includes a NIC (Network Interface Card) and/or a modem. Network I/F unit 26 communicably connects client terminal 20 to communication network 50 so as to send a job to printing device 30.

Display unit 27 includes a display like a LCD (liquid crystal display) or an OEL (organic electroluminescence) display, so as to display various screens including document creation screens of applications 21*b* and a print setup screen of printer driver 21*c*.

Operation unit 28 includes input devices, such as a mouse and a keyboard, which allows an operator to perform various operations including operations for creating a document by using one of applications 21*b* and operations for configuring print settings by using printer driver 21*c*.

Printing Device:

Printing device 30 is an apparatus configured to process a print job received from client terminal 20, where examples of printing device 30 include MFPs (multi-functional peripherals). Printing device 30 includes, as illustrated in FIG. 4 and FIG. 5A, built-in controller 31, storage unit 35, network interface (I/F) unit 36, display and operation unit 37, image processor 38, sheet feeder 39, printing unit 40, sheet inserter 41, sheet cutter 42, sheet buffer 43, post-processing unit 44, sheet stacker 45 and sheet transporter 46. Sheet transporter 46 is configured to transport media sheets fed from sheet feeder 39 or sheet inserter 41 toward sheet stacker 45 along the sheet path. Printing unit 40, sheet cutter 42 and post-processing unit 44 are disposed along the sheet path. Sheet inserter 41 is disposed so as to insert insertion sheets to a position upstream of the sheet cutter 42 on the sheet path. Sheet buffer 43 is disposed on a branch line, which branches off from the sheet path at a branch position on the sheet path between the sheet cutter 42 and sheet stacker 45.

Built-in controller 31 includes CPU 32 as a hardware processor, and memories including ROM 33 and RAM 34. CPU 32 reads out control programs stored in ROM 33 or storage unit 35, loads the control programs onto RAM 34, and executes the control programs (including the program for controlling transportation of media sheets, which will be described later), thereby controlling operations of the components of printing device 30.

As illustrated in FIG. 5B, built-in controller 31 is configured to work as setting controller 31*a*, sheet transportation controller 31*b* and sheet-feeding interval calculator 31*c*.

Setting controller 31*a* is configured to perform the following operations. Setting controller 31*a* analyzes a print job, and uses print settings to judge whether instructions to divide media sheets are specified in the print job. Judging that instructions to divide media sheets are specified in the print job, setting controller 31 sets the number of cut pieces given by a division of each media sheet by cutting (the way to divide each media sheets, in other words, how many times to cut each media sheets in which direction). For example, in a case that two-in-one imposition is specified in the print job, setting controller 31*a* sets the number of cut media sheets to be given by a division of each media sheets, to two. Setting controller 31 further uses print settings to judge whether instructions to use insertion sheets are specified in the print job. Judging that instructions to use insertion sheets are specified in the print job, setting controller 31*a* configures settings about handling of insertion sheets. For example, setting controller 31*a* sets whether to put insertion sheets between the cut media sheets or not, and sets the sheet insertion mode to the pre-sheet insertion mode or the post-sheet insertion mode. In concrete terms, the sheet insertion mode is a mode indicating the way to insert, from sheet inserter 41, an insertion sheet to be put between cut media sheets given by a division of a printed media sheet, into the sheet path. The pre-sheet insertion mode is a mode in which the insertion sheet is inserted into the sheet path so that the insertion sheet passes through sheet cutter 42 before sheet cutter 42 divides the printed media sheet by cutting. The post-sheet insertion mode is a mode in which the insertion sheet is inserted into the sheet path so that the insertion sheet passes through sheet cutter 42 after sheet cutter 42 divides the printed media sheet by cutting.

Sheet transportation controller 31*b* is configured to control sheet transporter 46 to perform the following operations. In a case that the instructions to put insertion sheets between cut media sheets are specified in the print job, sheet transportation controller 31*b* checks the sheet insertion mode currently specified, and causes sheet transporter 46 to perform the media sheet transportation in the processes of putting media sheets from sheet feeder 39 into the sheet path, print processing in printing unit 40, inserting insertion sheets from sheet inserter 41 into the sheet path, cutting media sheets by sheet cutter 42, transporting a media sheet into sheet buffer 43, performing post-processing by post-processing unit 44, and stacking media sheets in sheet stacker 45. With the operations to control the media sheet transportation, the sheet transportation controller 31*b* changes the order of cut media sheets given by a division of a media sheet by sheet cutter 42 and an insertion sheet which are transported in the sheet path, so that the insertion sheet is positioned between the cut media sheets and the insertion sheet and the cut media sheets are transported toward sheet stacker 45 in the resulting order. In concrete terms, in a case that the sheet-insertion mode is set to the pre-sheet insertion mode, sheet transportation controller 31*b* causes sheet transporter 46 to put an insertion sheet from sheet inserter 41 into the sheet path as a starter and transport the insertion sheet so that the insertion sheet passes through sheet cutter 42 and is put into sheet buffer 43. After that, sheet transportation controller 31*b* causes sheet transporter 46 to feed a media sheet from sheet feeder 39 into the sheet path, causes printing unit 40 to perform print processing on the media sheet, and causes sheet cutter 42 to divide the printed media sheet into cut media sheets by cutting. Sheet transportation controller 31*b* then causes sheet transporter 46 to start the transportation of a leading part of the cut media sheets (one or more leading cut media sheets among the cut media sheets) toward sheet stacker 45, and after the leading part of the cut media sheets has passed through the branch position on the sheet path (the position where the sheet path branches off to sheet buffer 43), sheet transportation controller 31*b* causes sheet transporter 46 to return the insertion sheet kept in sheet buffer 43 into the sheet path through the branch position, and after that, to start the transportation of a succeeding part of the cut media sheets (one or more succeeding cut media sheets that follows the one or more leading cut media sheets among the cut media sheets), toward sheet stacker 45. In another case that the sheet-insertion mode is set to the post-sheet insertion mode, sheet transportation controller 31*b* causes sheet transporter 46 to put a media sheet from sheet feeder 39 into the sheet path as a starter, causes printing unit 40 to perform print processing on the media sheet, and causes sheet cutter 42 to divide the printed media sheet into cut media sheets by cutting. Sheet transportation controller 31*b* then causes sheet transporter 46 to start the transportation of a leading part of the cut medias sheets (one or more leading cut media sheets among the cut media sheets), along the sheet path toward sheet stacker 45, and then transport an end part of the cut media sheets (one or more end cut media sheets that are positioned at the most downstream position and follow the one or more leading cut media sheets among the cut media sheets), along the sheet path into sheet buffer 43. After that, sheet transportation controller 31*b* causes sheet transporter 46 to put an insertion sheet from sheet inserter 41 into the sheet path and transport the insertion sheet toward sheet stacker 45. After the insertion sheet has passed through sheet cutter 42 and the branch position on the sheet path (the position where the sheet path branches off to sheet buffer 43), sheet transportation controller 31*b* causes sheet transporter 46 to return the end part of the cut media sheets kept in sheet buffer 43 into the sheet path, and start transportation of the end part of the cut media sheets toward sheet stacker 45.

Sheet-feeding interval calculator 31*c* is configured to calculate a sheet-feeding interval to be used for controlling the time to feed each of media sheets to sheet cutter 42. In concrete terms, in a case that the sheet insertion mode is set to the pre-sheet insertion mode and an insertion sheet has already been transported into sheet buffer 43, sheet-feeding interval calculator 31*c* obtains a time period necessary for sheet cutter 42 to cut one of media sheets into cut media sheets, a time period necessary for sheet transporter 46 to return the insertion sheet from sheet buffer 43 into the sheet path, and an interval of the cut media sheets (an interval at which sheet transporter 46 transports the cut media sheets). In another case that the sheet insertion mode is set to the pre-sheet insertion mode and an insertion sheet has not been transported into sheet buffer 43 yet, sheet-feeding interval calculator 31*c* obtains a time period necessary for sheet cutter 42 to cut one of media sheets into cut media sheets, a time period necessary for sheet transporter 46 to transport an insertion sheet inserted into the sheet path by sheet inserter 41, into sheet buffer 43, a time period necessary for sheet transporter 46 to return the insertion sheet from sheet buffer 43 into the sheet path, and an interval of the cut media sheets (an interval at which sheet transporter 46 transports the cut media sheets). In another case that the sheet insertion mode is set to the post-sheet insertion mode, sheet-feeding interval calculator 31*c* obtains a time period necessary for sheet cutter 42 to cut one of media sheets into cut media sheets, a time period necessary for sheet transporter 46 to transport an end part of the cut media sheets (one or more end cut media sheets among the cut media sheets) into sheet buffer 43, a time period necessary for sheet transporter 46 to return the end part of the cut media sheets from sheet buffer 43 into the sheet path, and an interval of the cut media sheets (an interval at which sheet transporter 46 transports the cut media sheets). Sheet-feeding interval calculator 31*c* then calculates the sheet-feeding interval by using the obtained time periods.

The setting controller 31*a*, sheet transportation controller 31*b* and sheet-feeding interval calculator 31*c* may be constituted as hardware devices. Alternatively, the setting controller 31*a*, sheet transportation controller 31*b* and sheet-feeding interval calculator 31*c* (particularly, setting controller 31*a* and sheet transportation controller 31*b*) may be provided by the program for controlling transportation of media sheets, which causes built-in controller 31 to function as these components when being executed by CPU 32. That is, built-in controller 31 may be configured to serve as the setting controller 31*a*, sheet transportation controller 31*b* and sheet-feeding interval calculator 31*c* (particularly, setting controller 31*a* and sheet transportation controller 31*b*), when CPU 32 executes the program for controlling transportation of media sheets.

Storage unit 35 is a non-transitory computer-readable recording medium including a HDD and/or a SSD. Storage unit 35 stores programs which, when being executed, cause CPU 32 to control operations of the components of printing device 30; information about processing and functions of printing device 30; a print job; image data created by image processor 38; a sheet-feeding interval calculated by sheet-feeding interval calculator 31*c*; and other data.

Network I/F unit 36 includes a NIC and/or a modem. Network I/F unit 36 communicably connects printing device 30 to communication network 50 so that printing device 30 can receive a print job from client terminal 20.

Display and operation unit 37 is configured to display various screens (including a screen that instructs an operator to load insertion sheets onto sheet inserter 41, and a screen that allows an operator to specify the sheet insertion mode), and to allow an operator to perform various kinds of operations (including operations to specify the sheet insertion mode) on the screens. Examples of the display and operation unit 37 include a touch screen in which an operation unit that works as an input device (a resistive touch sensor composed of lattice-shaped transparent electrodes or a capacitive touch sensor) is arranged on a display unit like a LCD or an OEL display. In the present embodiment, a touch screen, in which a display unit and an operation unit are housed in one body, is employed as an instance of display and operation unit 37, but alternatively, a display unit and an operation unit as separated bodies may be employed as an instance of display and operation unit 37.

Image processor 38 serves as a RIP (raster image processor) and is configured to translate a print job into intermediate data (an intermediate format called the display list or DL), and then rasterizes pages of the document in the print job to create bitmap image data. Image processor 38 is further configured to perform image processing, such as screening, tone correction, density-balance adjustment, thinning, halftoning and other processing, on image data as needed, and output the resulting image data to printing unit 40.

Sheet feeder 39 includes one or more feed trays so as to feed media sheets loaded on a feed tray to printing unit 40 through the sheet path.

Printing unit 40 is a print engine that is configured to use image data on which image processing was performed by image processor 38, to perform print processing on media sheets. Printing unit 40 includes components necessary for forming images on media sheets by using electrographic processes or electrostatic recording process, in other words, includes, for example, a charging unit, a photoreceptor drum, an exposure unit, a developing unit, transfer rollers, a transfer belt and a fixing unit. In concrete terms, printing unit 40 is configured to perform print processing as follows. The charging unit charges the photoreceptor drum, and the exposure unit irradiates the photoreceptor drum with a laser beam in accordance with image data, to create a latent image. The developing unit adheres charged toner onto the photoreceptor drum, to develop the toner image. The toner image is transferred onto a media sheet by the transfer rollers (for the first transfer process) and the transfer belt (for the second transfer process). The fixing unit then fixes the toner image onto a media sheet.

Sheet inserter 42 includes one or more insertion tray for loading insertion sheets, which are media sheets not to be subjected to print processing, such as media sheets printed by an external printing device in advance, interleaving sheets or blank sheets. Sheet inserter 42 is disposed so as to insert the insertion sheets loaded on an insertion tray into the sheet path (to put the insertion sheets to a position upstream of the sheet cutter 42 on the sheet path, in other words, a position between the printing unit 40 and sheet cutter 42 on the sheet path).

Sheet cutter 42 is disposed on the sheet path and is configured to receive printed media sheets on which printing unit 40 formed images and divide each of the printed media sheets into two or more cut media sheets that lie in the sheet path, by cutting each of the printed media sheets in a direction crossing the sheet path (the cross-machine direction).

Sheet buffer 43 is disposed upstream of sheet cutter 42, that is, disposed on a branch line branching off from the sheet path at a branch position (see the branch position enclosed by dotted line in FIG. 4) on the sheet path between sheet cutter 42 and sheet stacker 45. Sheet buffer 42 is configured to keep an end part of cut media sheets given by a division of a printed media sheet with sheet cutter 42 (one or more end cut media sheets among the cut media sheets), or one or more insertion sheets inserted into the sheet path from sheet inserter 41, at a buffer area in sheet buffer 42, so as to leave the sheet path temporarily.

Post-processing unit 44 is prepared in printing device 30 as needed, and is configured to perform post processing, such as hole punching, stapling and binding processing, on cut media sheets given by a division of printed media sheets with sheet cutter 42 and insertion sheets fed from sheet inserter 41.

Sheet stacker 45 includes one or more output trays for loading a stack of media sheets transported by sheet transporter 46, including cut media sheets given by a division of printed media sheets with sheet cutter 42 and insertion sheets fed from sheet inserter 41. Sheet transporter 46 includes various rollers including pairs of rollers, that press and hold media sheets between the rollers and rotate so as to transport media sheets fed from sheet feeder 39, cut media sheets given by a division of printed media sheets with sheet cutter 42 and insertion sheets fed from sheet inserter 41, along the sheet path toward post-processing unit 44 or sheet stacker 45.

It should be noted that FIG. 1 to FIG. 5B illustrated an example of printing system 10 according to the present embodiment for illustrative purpose only, and the constitution and operations of each apparatus in the system may be modified appropriately, as far as the above-described operations of printing device 30 can be executed in the system.

For example, printing device 30 illustrated in FIG. 4 and FIGS. 5A and 5B is configured to divide printed media sheets by cutting and put insertion sheets between the cut media sheets, but alternatively, printing device 30 may be configured to perform only print processing on media sheets and another device in printing system 10 (for example, a device capable of dividing a media sheet into multiple cut media sheets by cutting and of putting an insertion sheet between the cut media sheets, like finisher 60 in printing system 10 illustrated in FIG. 2) may perform the operations to put insertion sheets between cut media sheets. In this case, the device may include a built-in controller, a sheet inserter, a sheet cutter, a sheet buffer, a sheet transporter and a sheet stacker, and as needed, further include a post-processing unit, similarly to those of printing device 30; and the built-in controller of the device may be configured to work as the setting controller, the sheet transportation controller and the sheet-feeding interval calculator (when the program for controlling transportation of media sheets is executed by the hardware processor of the device), so as to control the sheet transporter to feed media sheets printed by printing device 30 to the sheet cutter through the sheet path, cause the sheet cutter to divide each of the printed media sheet into cut media sheets by cutting, and put insertion sheets between the cut media sheets.

For another example, printing system 10 of the present embodiment has the constitution that printing device 30 receives a print job from client terminal 20, but alternatively, printing device 30 may receive a print job from a server communicably connected to communication network 50 or obtain a print job from a memory like a USB (Universal Serial Bus) memory. In this case, client terminal 20 may be omitted from printing system 10.

Operations to Control Print Processing and Media Sheet Transportation:

Hereinafter, a description is given of concrete operations to control print processing and media sheet transportation to be executed in printing system 10, with reference to FIGS. 6A to 14E.

Figure 6A:
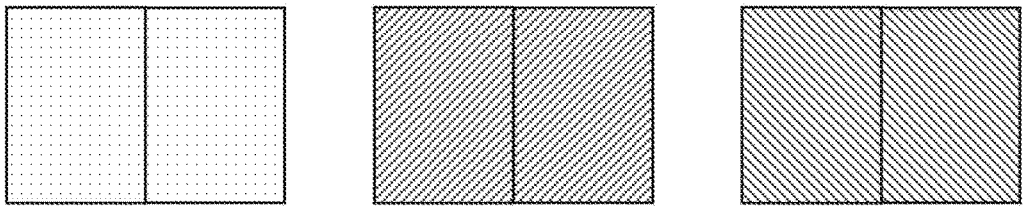
FIG. 6A RELATED ART
FIGS. 6A to 6E are diagrams illustrating an example of a basic way to control print processing and transportation of media sheets, in which media sheets are cut into small-size sheets.
Figure 6B:
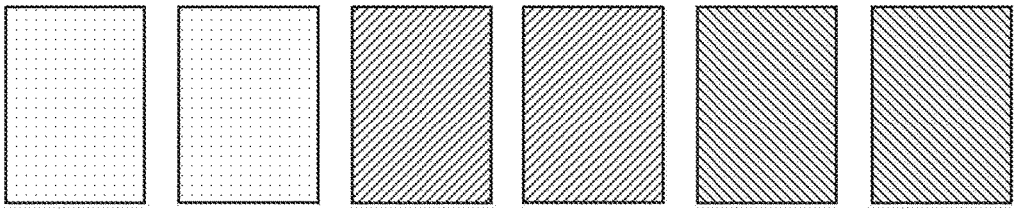
FIG. 6B RELATED ART
Figure 6C:
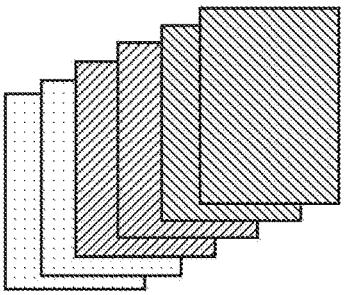
FIG. 6C RELATED ART
Figure 6D:
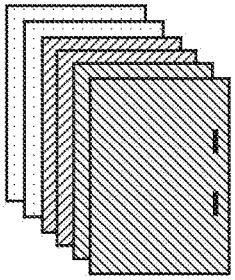
FIG. 6D RELATED ART
Figure 6E:
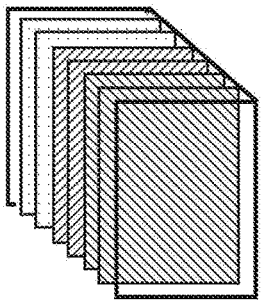
FIG. 6E RELATED ART

FIGS. 6A to 6E are schematic diagrams illustrating an example of a basic way to control print processing and media sheet transportation, in which media sheets are divided into small-size sheets by cutting. In FIGS. 6A and 6B, it is assumed that the sheets are transported by sheet transporter 46 according to instructions of sheet transportation controller 31*b*, to the left-hand side of the figures. As illustrated in FIG. 6A, sheet transporter 46 feeds three media sheets (media sheets in the figures are filled with different hatch patterns so that the media sheets can be distinguished from each other) from sheet feeder 39 into the sheet path, and printing unit 40 performs print processing on the media sheets (for example, two-in-one imposition printing). As illustrated in FIG. 6B, sheet cutter 42 divides each of the printed media sheets into multiple (two) cut media sheets by cutting, and sheet transporter 46 transports the cut media sheets along the sheet path. After that, the cut media sheets are transported by sheet transporter 46 and stacked on sheet stacker 45 in order, as illustrated in FIG. 6C, or are transported by sheet transporter 46 to post-processing unit 44 and are output with being stapled or bound into a booklet as illustrated in FIG. 6D or FIG. 6E.

Figure 7A:
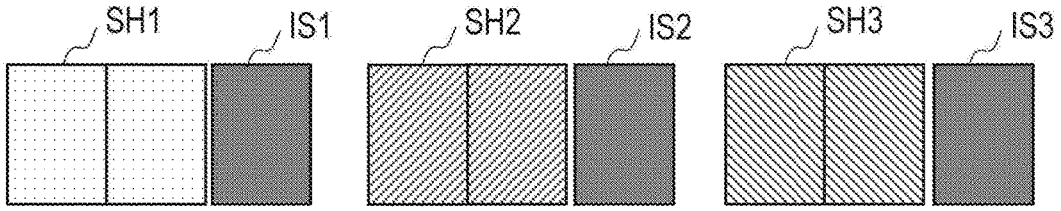
FIG. 7A RELATED ART
FIGS. 7A to 7E are diagrams illustrating an example of an ordinary way to control print processing and transportation of media sheets, using insertion sheets to be put between media sheets.
Figure 7B:
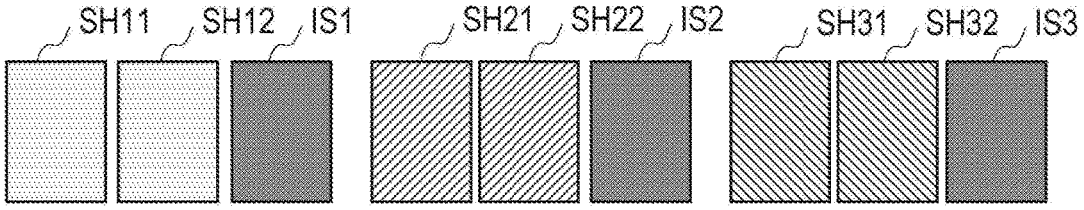
FIG. 7B RELATED ART
Figure 7C:
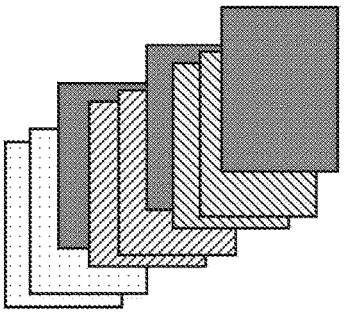
FIG. 7C RELATED ART
Figure 7D:
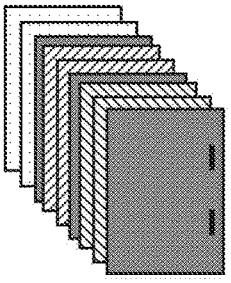
FIG. 7D RELATED ART
Figure 7E:
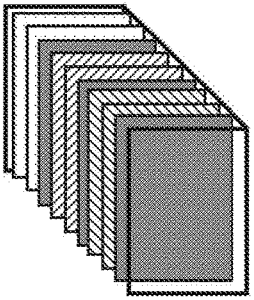
FIG. 7E RELATED ART

FIGS. 7A to 7E are schematic diagrams illustrating an example of an ordinary way to control print processing and sheet transportation, in which insertion sheets are inserted between media sheets. In FIGS. 7A and 7B, it is assumed that the sheets are transported by sheet transporter 46 according to instructions of sheet transportation controller 31*b*, to the left-hand side of the figures. In this example, as illustrated in FIG. 7A, sheet transporter 46 feeds three media sheets (SH1 to SH3) from sheet feeder 39 into the sheet path and transports the media sheets along the sheet path to printing unit 40, printing unit 40 performs print processing (for example, two-in-one imposition printing) on the media sheets, and sheet transporter 46 puts insertion sheets (IS1 to IS3) next to the respective media sheets. In this example, as illustrated in FIG. 7B, sheet cutter 42 divides each of the printed media sheets into two cut media sheets (SH11, SH12, SH21, SH22, SH31, SH32) by cutting, and sheet transporter 46 transports three sets of two cut media sheets followed by one insertion sheet, in series. After that, the cut media sheets and the insertion sheets are transported by sheet transporter 46 and stacked on sheet stacker 45 in order along the sheet path, as illustrated in FIG. 7C, or are transported by sheet transporter 46 to post-processing unit 44 and are output with being stapled or bound into a booklet as illustrated in FIG. 7D or FIG. 7E. The operations to control the media sheet transportation in which insertion sheets are put between cut media sheets, allow printing device 30 to make booklets including various combinations of cut media sheets and insertion sheets, but with the operations, it is difficult to put an insertion sheet between cut media sheets given by a division of each printed media sheet.

Figure 8A:
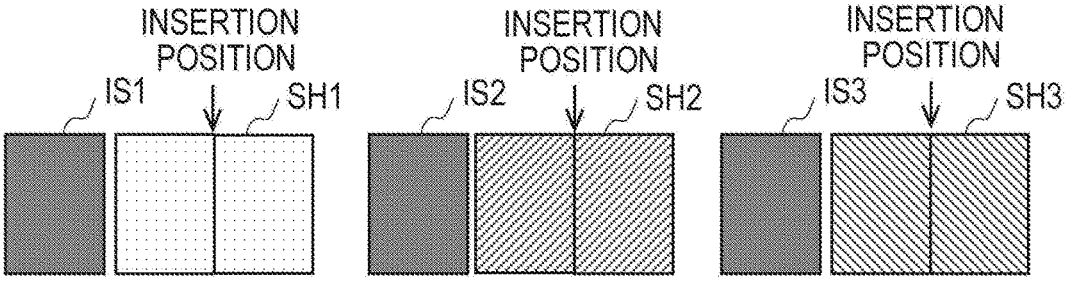
FIGS. 8A to 8D are diagrams illustrating a basic idea to control transportation of media sheets so as to put insertion sheets between cut media sheets, according to the present embodiment.
Figure 8B:
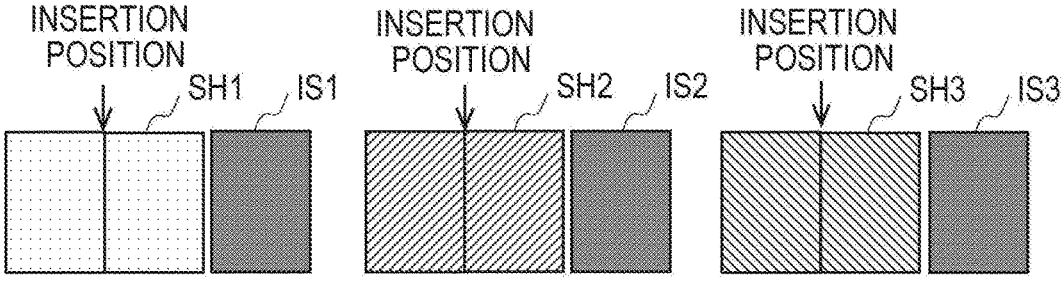
Figure 8C:
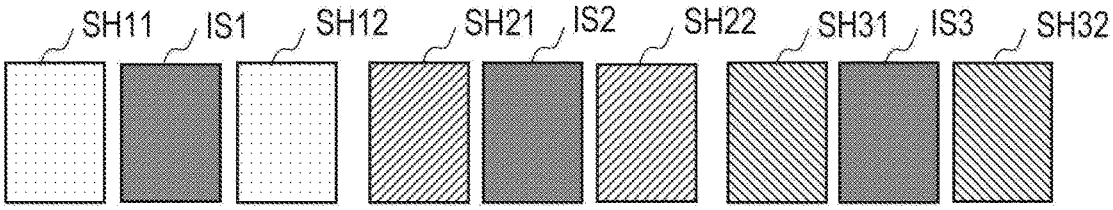
Figure 8D:
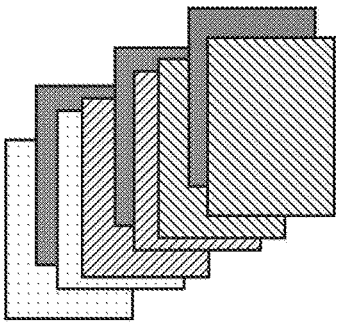

FIGS. 8A to 8D are schematic diagrams illustrating a basic idea to control the transport of media sheets so as to put an insertion sheet between cut media sheets given by a division of each printed media sheet, according to the present embodiment. In FIG. 8A to 8C, it is assumed that the sheets are transported by sheet transporter 46 according to instructions of sheet transportation controller 31*b*, to the left-hand side of the figures. In this example, sheet transporter 46 feeds three media sheets (SH1 to SH3) from sheet feeder 39 into the sheet path and transports the media sheets along the sheet path to printing unit 40, and printing unit 40 performs print processing on the media sheets. Sheet transporter 46 then puts insertion sheets (IS1 to IS3) into the sheet path so that the insertion sheets are positioned in front of or behind respective printed media sheets as illustrated in FIG. 8A and FIG. 8B. In order to transport cut media sheets (SH11 to SH32) given by a division of the printed media sheets and insertion sheets (IS1 to IS3) inserted into the sheet path from sheet feeder 39, to sheet stacker 45 or post-processing unit 44 with the insertion sheets put between cut media sheets given by a division of the respective media sheets, as illustrated in FIG. 8C, it is necessary to sort the cut media sheets and the insertion sheets during the transportation of the cut media sheets and the insertion sheets. There are two modes of inserting the insertion sheets into the sheet path. First is the pre-sheet insertion mode in which insertion sheets are inserted into the sheet path in front of respective media sheets as illustrated in FIG. 8A, and second is the post-sheet insertion mode in which insertion sheets are inserted into the sheet path behind respective media sheets as illustrated in FIG. 8B. In order to sort the cut media sheets and the insertion sheets, there is a need for a mechanism to put an insertion sheet between cut media sheets given by a division of each printed media sheet (please see the insertion positions illustrated in FIGS. 8A and 8B) during the transportation of the sheets. The present embodiment employs sheet buffer 43 disposed downstream of sheet cutter 42. In the media sheet transportation in the pre-sheet insertion mode, sheet transportation controller 31*b* controls sheet transporter 46 to put an insertion sheet from sheet inserter 41 into the sheet path and transport the insertion sheet so that the insertion sheet passes through sheet cutter 42 and goes into sheet buffer 43, before sheet cutter 42 divides a printed media sheet by cutting. In the media sheet transportation in the post-sheet insertion mode, sheet transportation controller 31*b* controls sheet transporter 46 to, after sheet cutter 42 divides a printed media sheet into cut media sheets by cutting, transport an end part of the cut media sheets (one or more cut media sheets positioned at the most downstream position in the cut media sheets) into sheet buffer 43 and then put an insertion sheet from sheet inserter 41 into the sheet path to transport the insertion sheet along the sheet path toward post-processing unit 44 or sheet stacker 45 through sheet cutter 42. After that, the cut media sheets and the insertion sheets are transported by sheet transporter 46 and stacked on sheet stacker 45 in order along the sheet path, as illustrated in FIG. 8D, or are transported by sheet transporter 46 to post-processing unit 44 and are output with being stapled or bound into a booklet.

FIG. 9A to 14E are diagrams illustrating a concrete example of the way to control the media sheet transportation illustrated in FIGS. 8A to 8D. FIGS. 9A to 11E are diagrams illustrating an example of the way to control the media sheet transportation in a case of the pre-sheet insertion mode. FIGS. 12A to 14E are diagrams illustrating an example of the way to control the media sheet transportation in a case of the post-sheet insertion mode. It should be noted that the following description gives an example of the way to control the media sheet transportation in which insertion sheets are put between cut media sheets given by a division of respective media sheets, but alternatively, insertion sheets may be put between media sheets before cutting and/or between media sheets given by a division of different media sheets by cutting, additionally to between the cut media sheets as described above.

Figure 9A:
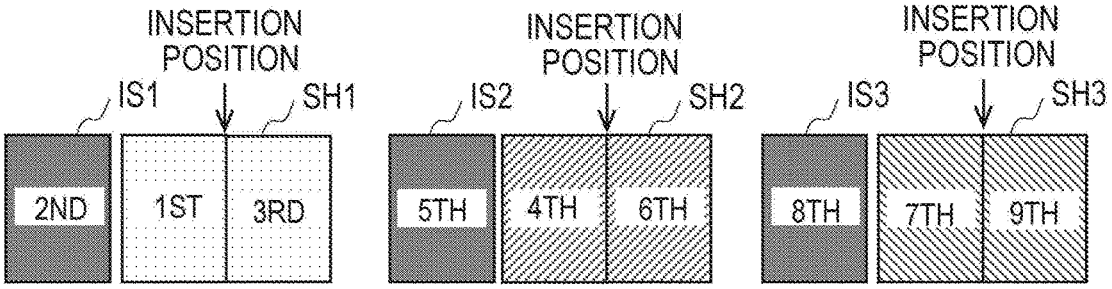
FIGS. 9A to 9C are schematic diagrams illustrating a way to change the order of media sheets in a sheet path, in a case of media sheet transportation in the pre-sheet insertion mode, according to the present embodiment.
Figure 9B:
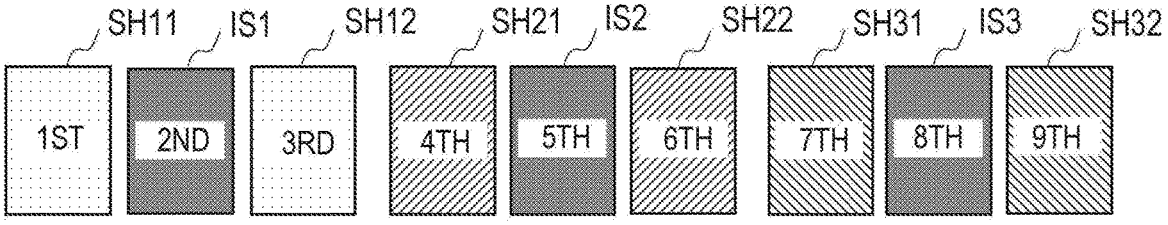
Figure 9C:
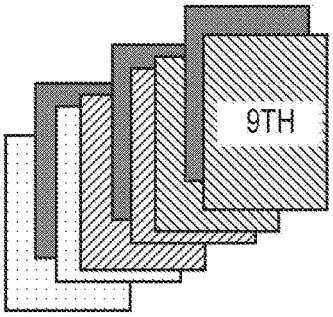

Operations in Pre-Sheet Insertion Mode:

FIGS. 9A to 9C are diagrams illustrating an example of the way to change the order of media sheets in a sheet path in a case of the media sheet transportation in the pre-sheet insertion mode. In FIGS. 9A and 9B, numbers shown on the respective sheets indicate the order in which the sheets are to be transported along the sheet path to post-processing unit 44 or sheet stacker 45 (referred to as the transportation order), and it is assumed that the sheets are transported by sheet transporter 46 to the left-hand side of the figures. In this example, sheet transporter 46 puts three media sheets (SH1 to SH3) from sheet feeder 39 into the sheet path and transports the media sheets to printing unit 40, and printing unit 40 performs print processing on the media sheets. Sheet transporter 46 then puts insertion sheets (IS1 to IS3) from sheet inserter 41 in front of the respective media sheets (SH1 to SH3), and transports all the sheets along the sheet path in order illustrated in FIG. 9A (the order of IS1, SH1, IS2, SH2, IS3 and SH3). In order to make a stack of cut media sheets (SH11 to SH32) given by a division of the media sheets (SH1 to SH3) and insertion sheets (IS1 to IS3) in post-processing unit 44 or sheet stacker 45, with the insertion sheets put between the cut media sheets (please see the insertion positions in FIG. 9A), as illustrated in FIG. 9C, it is necessary to sort the cut media sheets and the insertion sheets so as to put the insertion sheets between the cut media sheets given by a division of the respective media sheets, during the transportation of the cut media sheets and the insertion sheets, as illustrated in FIG. 9B. To create a stack of the sheets, sheet transporter 46 changes the transportation order of the sheets according to the order of the sheets in the stack to be made in the post-processing unit 44 or sheet stacker 45. In concrete terms, in the case of pre-sheet insertion mode, the media sheet transportation is controlled so as to transpose the page number of an insertion sheet and the page number of a leading part of the cut media sheet that is a cut media sheet transported immediately after the insertion sheet among the cut media sheets in this case.

Figure 10A:
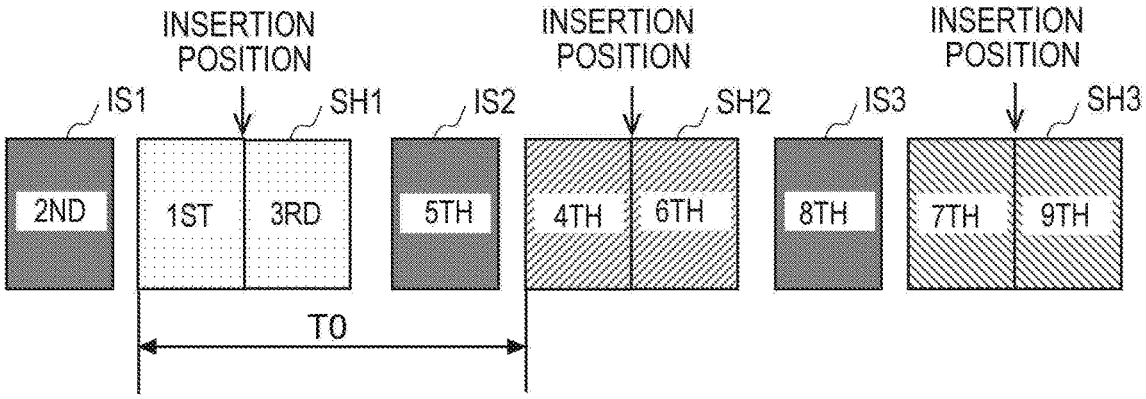
FIGS. 10A and 10B are schematic diagrams illustrating an interval at which media sheets are to be fed to a sheet cutter, in a case of the media sheet transportation in the pre-sheet insertion mode, according to the present embodiment.
Figure 10B:
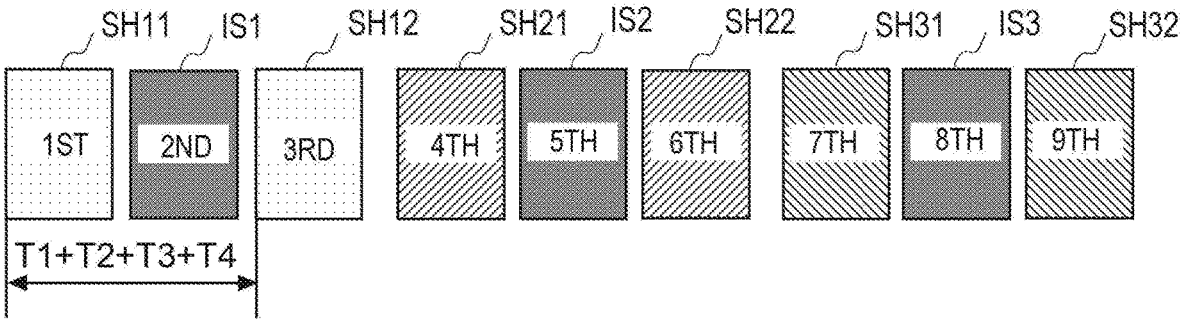

FIGS. 10A and 10B are schematic diagrams illustrating the sheet-feeding interval that allows to change the transportation order of the sheets properly. In FIGS. 10A and 10B, numbers shown on the respective sheets indicate the order in which the sheets are to be transported along the sheet path to post-processing unit 44 or sheet stacker 45 (the transportation order), and it is assumed that the sheets are transported by sheet transporter 46 to the left-hand side of the figures. FIG. 10A illustrates sheet-feeding interval T0 at which media sheets are to be fed to sheet cutter 42. Sheet-feeding interval T0 is calculated by using (for example, by calculating the total sum of) first time period T1 that is necessary for sheet cutter 42 to cut one of printed media sheets (SH1 to SH3) and the time period necessary for sheet transporter 46 to insert each of the insertion sheets (IS1 to IS3) between cut media sheets (SH11 and SH12, SH21 and SH22, or SH31 and SH32; please see the insertion positions in FIG. 10A), as illustrated in FIG. 10B. The time period necessary for the sheet insertion is the sum of second time period T2 that is necessary for sheet transporter 46 to transport one of the insertion sheets inserted into the sheet path from sheet inserter 41, along the sheet path into sheet buffer 43, third time period T3 necessary for sheet transporter 46 to return the insertion sheet from sheet buffer 43 into the sheet path, and fourth time period T4 indicating the interval of the cut media sheets (the interval at which sheet transporter 46 transports the cut media sheets).

Figure 11A:
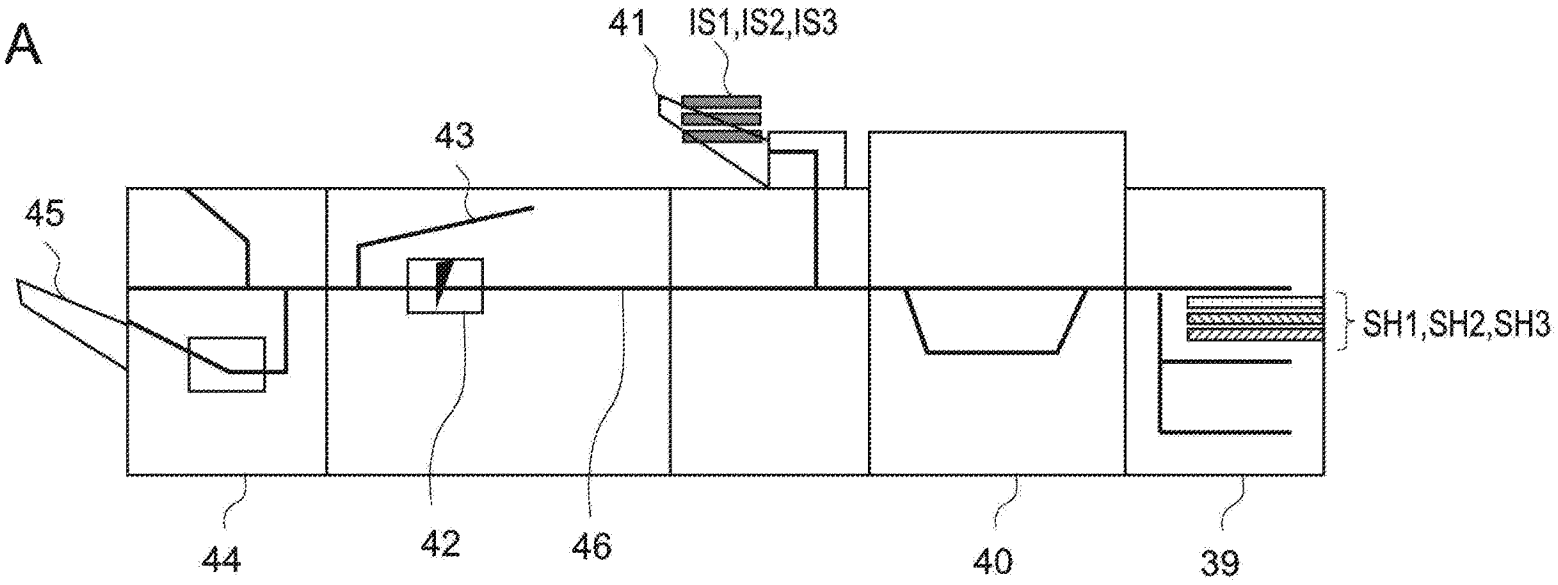
FIGS. 11A to 11E are schematic diagrams illustrating the way to control the media sheet transportation in the pre-sheet insertion mode, according to the present embodiment.
Figure 11B:
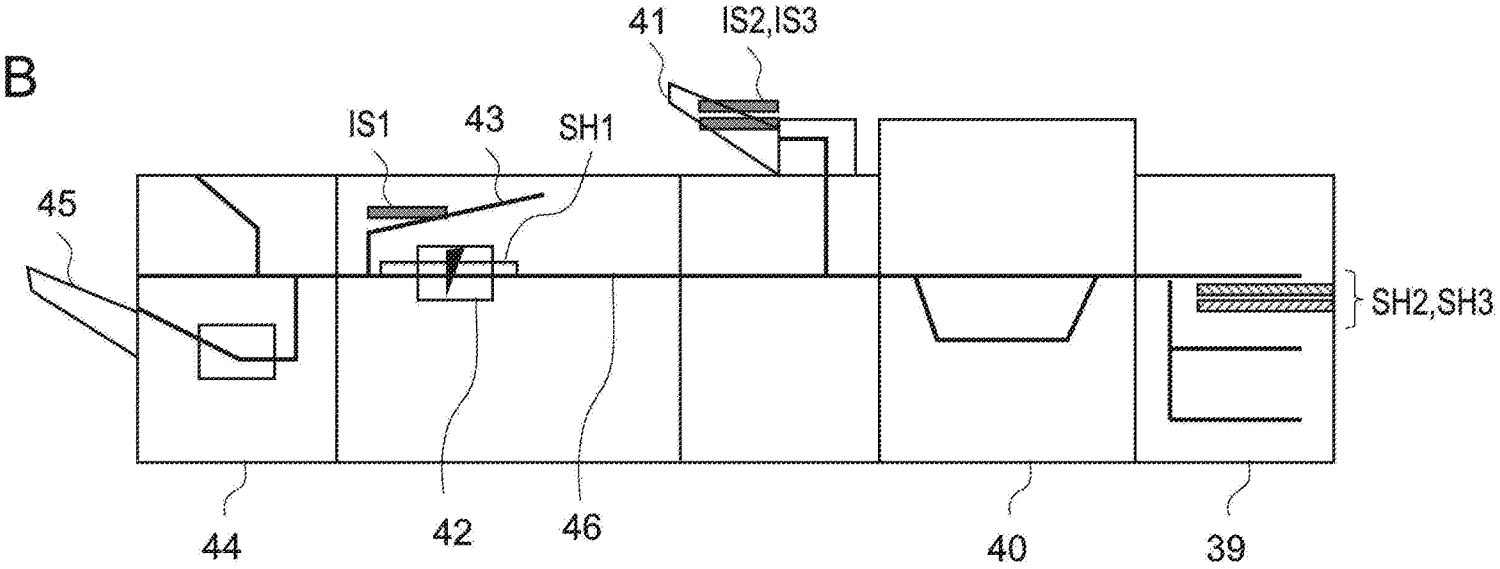
Figure 11C:
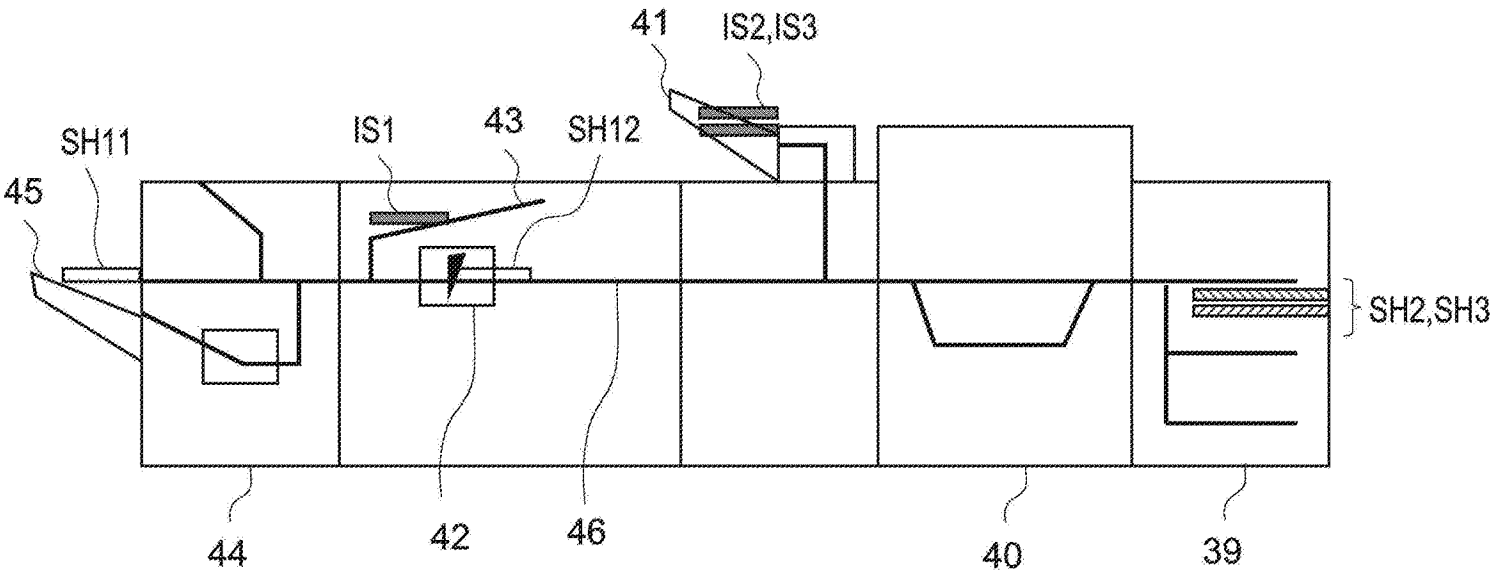
Figure 11D:
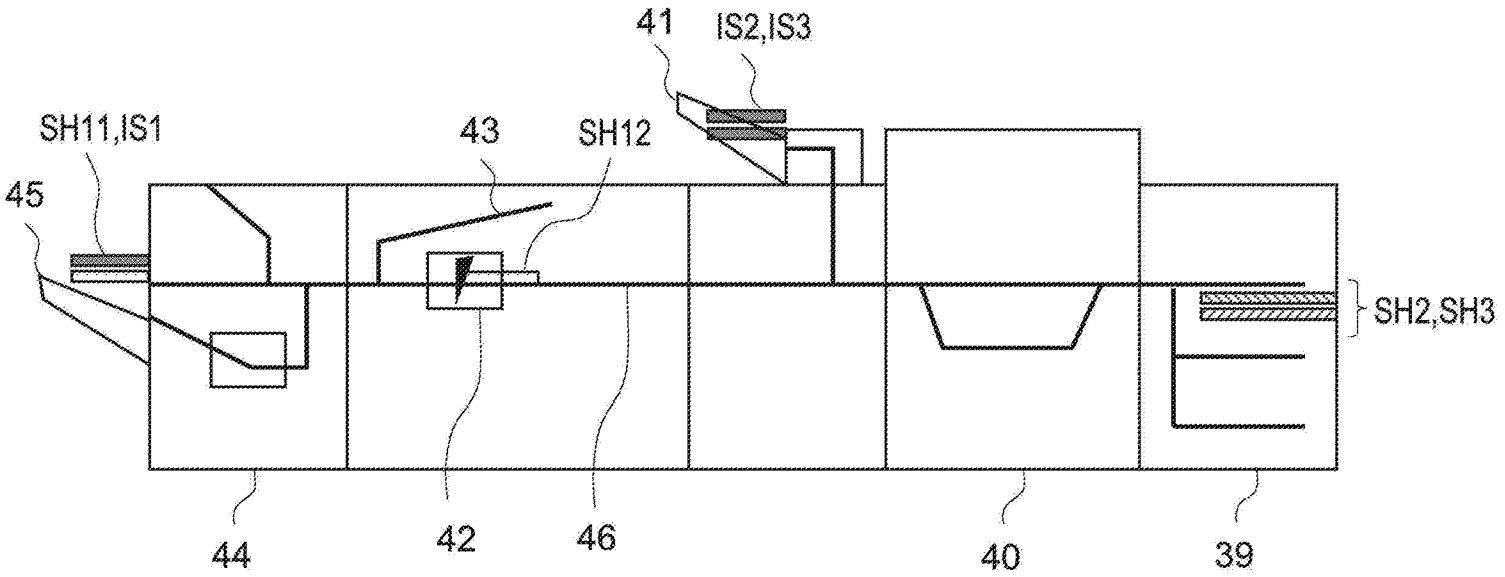
Figure 11E:
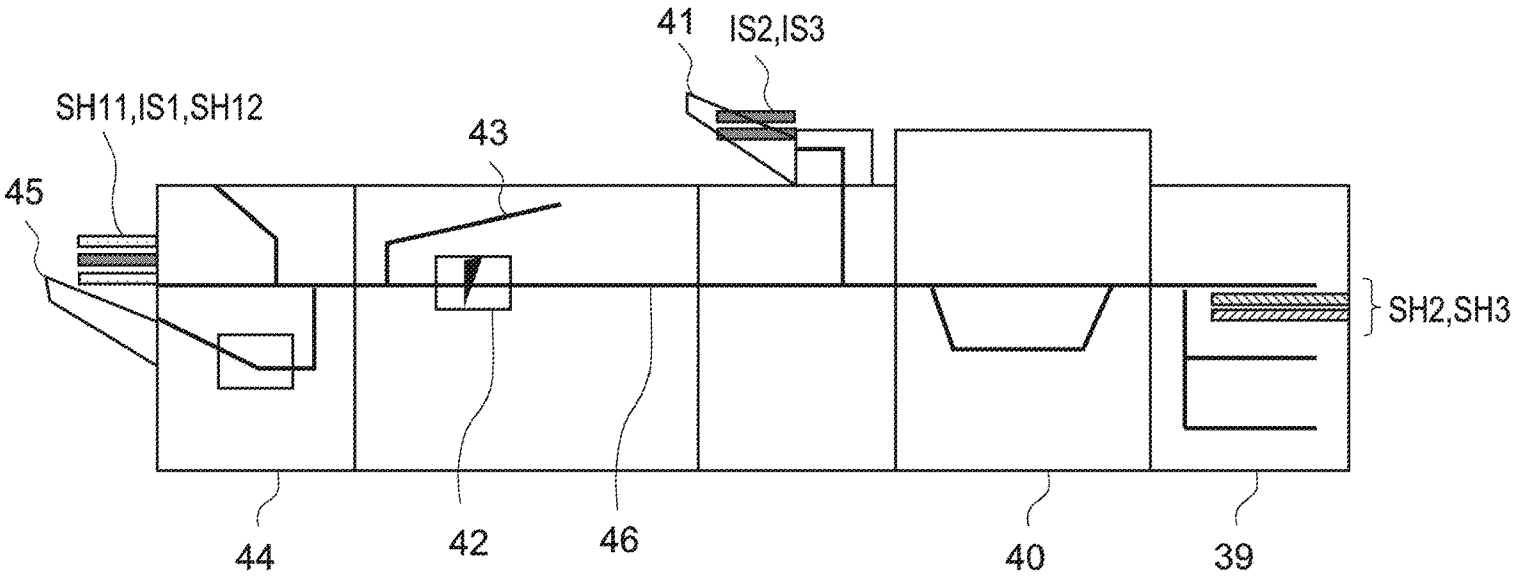

FIGS. 11A to 11E are schematic diagrams illustrating an example of the way to control the media sheet transportation in the pre-sheet insertion mode. The media sheet transportation in the pre-sheet insertion mode starts at the condition illustrated in FIG. UA, such that three media sheets (SH1 to SH3) are stored in sheet feeder 39 and three insertion sheets (IS1 to IS3) are loaded on sheet inserter 41, and results in that the insertion sheets are put between cut media sheets given by a division of respective media sheets. First, sheet transporter 46, as illustrated in FIG. 11B, puts one insertion sheet (IS1) into the sheet path, and transports the insertion sheet along the sheet path so that the insertion sheets passes through sheet cutter 42 and is put into sheet buffer 43. After that, sheet transporter 46 puts the first media sheet (SH1) from sheet feeder 39 into the sheet path and transports the sheet to printing unit 40. After printing unit 40 performs print processing on the first media sheet, sheet cutter 42 divides the first media sheet into two cut media sheets (SH11 and SH12) by cutting. Next, as illustrated in FIG. 11C, sheet transporter 46 transports the leading cut media sheet (SH11) to sheet stacker 45. Next, as illustrated in FIG. 11D, sheet transporter 46 returns the insertion sheet (IS1) kept in sheet buffer 43 into the sheet path, and transports the insertion sheet to sheet stacker 45. Next, as illustrated in FIG. 11E, sheet transporter 46 transports the succeeding cut media sheet (SH12) to sheet stacker 45. By performing the control of the media sheet transportation for the remaining media sheets (SH2, SH3) and the remaining insertion sheets (IS2, IS3) in printing unit 30 similarly, a stack of sheets in which insertion sheets are put between cut media sheets is realized as illustrated in FIG. 9C.

Figure 12A:
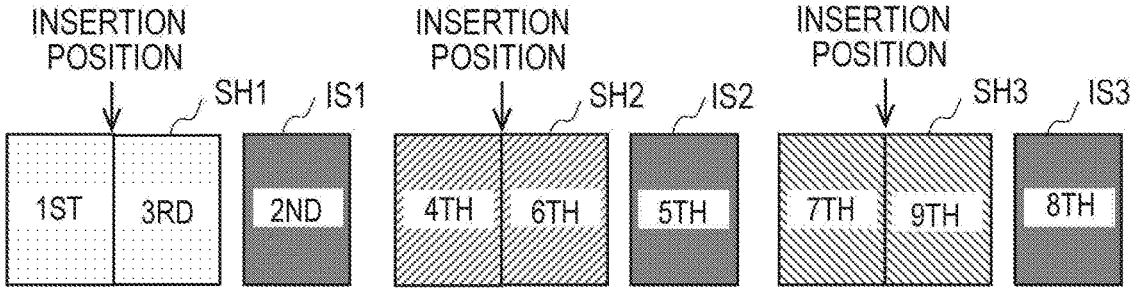
FIGS. 12A to 12C are schematic diagrams illustrating a way to change the order of media sheets in a sheet path, in a case of media sheet transportation in the post-sheet insertion mode, according to the present embodiment.
Figure 12B:
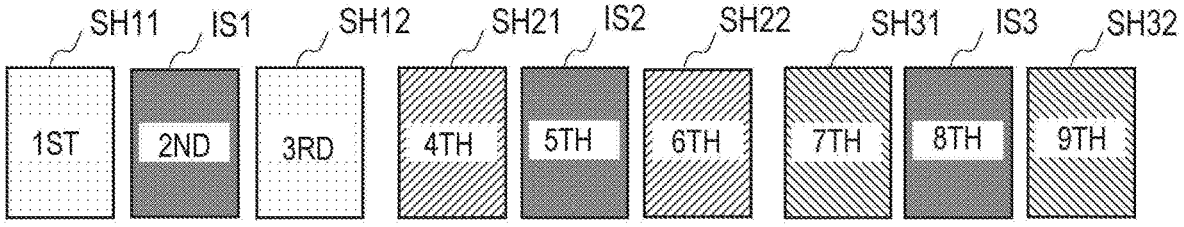
Figure 12C:
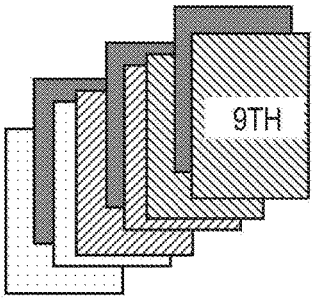

Operations in Post-Sheet Insertion Mode:

FIGS. 12A to 12C are diagrams illustrating an example of the way to change the order of media sheets in a sheet path in a case of the media sheet transportation in the post-sheet insertion mode. In FIGS. 12A and 12B, numbers shown on the respective sheets indicate the order in which the sheets are to be transported along the sheet path to post-processing unit 44 or sheet stacker 45 (referred to as the transportation order), and it is assumed that the sheets are transported by sheet transporter 46 to the left-hand side of the figures. In this example, sheet transporter 46 puts three media sheets (SH1 to SH3) from sheet feeder 39 into the sheet path and transports the media sheets to printing unit 40, and printing unit 40 performs print processing on the media sheets. Sheet transporter 46 then puts insertion sheets (IS1 to IS3) from sheet inserter 41 behind the respective media sheets (SH1 to SH3), and transports all the sheets along the sheet path in order illustrated in FIG. 12A (the order of SH1, IS1, SH2, IS2, SH3 and IS3). In order to make a stack of cut media sheets (SH11 to SH32) given by a division of the media sheets (SH1 to SH3) and insertion sheets (IS1 to IS3) in post-processing unit 44 or sheet stacker 45, with the insertion sheets put between the cut media sheets (please see the insertion positions in FIG. 12A), as illustrated in FIG. 12C, it is necessary to sort the cut media sheets and the insertion sheets so as to put the insertion sheets between the cut media sheets given by a division of the respective media sheets, during the transportation of the cut media sheets and the insertion sheets, as illustrated in FIG. 12B. To create a stack of the sheets, sheet transporter 46 changes the transportation order of the sheets according to the order of the sheets in the stack to be made in the post-processing unit 44 or sheet stacker 45. In concrete terms, in the case of post-sheet insertion mode, the media sheet transportation is controlled so as to transport the page number of an end part of the cut media sheet that is a cut media sheet at the most downstream position in the cut media sheets in this case, and the page number of an insertion sheet inserted immediately after the end cut media sheet.

Figure 13A:
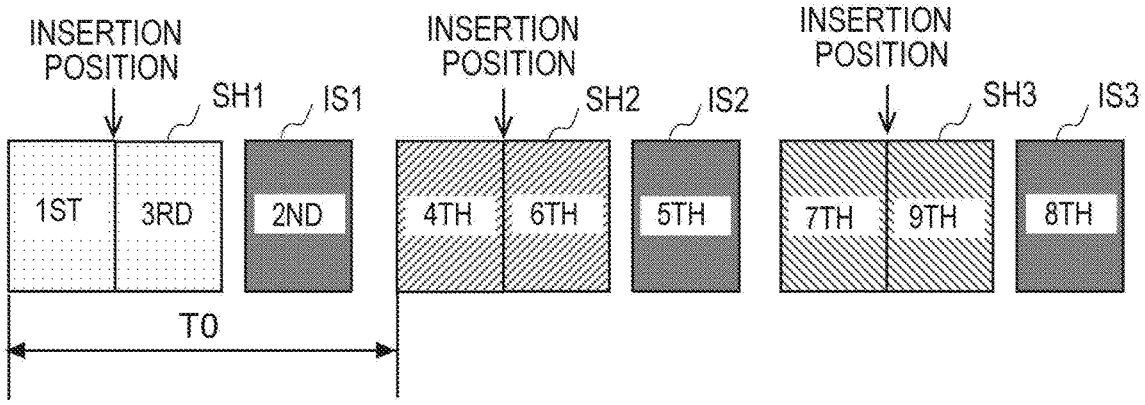
FIGS. 13A and 13B are schematic diagrams illustrating an interval at which media sheets are to be fed to a sheet cutter, in a case of the media sheet transportation in the post-sheet insertion mode, according to the present embodiment.
Figure 13B:
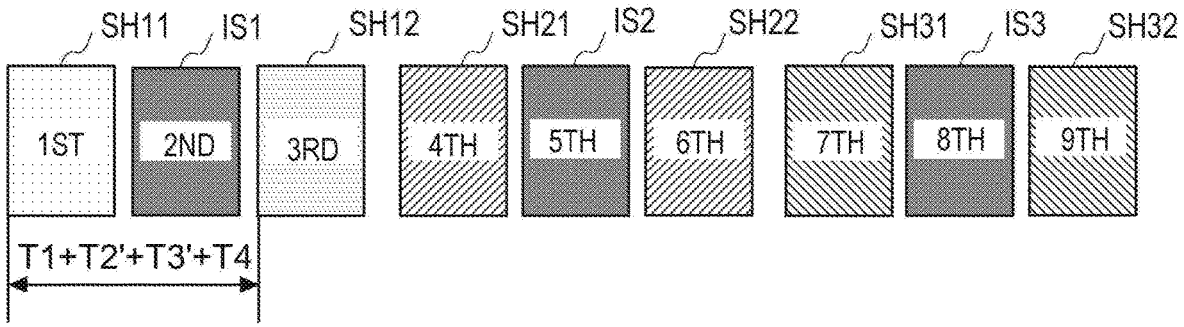

FIGS. 13A and 13B are schematic diagrams illustrating the sheet-feeding interval that allows to change the transportation order of the sheets properly. In FIGS. 13A and 13B, numbers shown on the respective sheets indicate the order in which the sheets are to be transported along the sheet path to post-processing unit 44 or sheet stacker 45 (the transportation order), and it is assumed that the sheets are transported by sheet transporter 46 to the left-hand side of the figures. FIG. 13A illustrates sheet-feeding interval T0 at which media sheets are to be fed to sheet cutter 42. Sheet-feeding interval T0 is calculated by using (by calculating the total sum of) first time period T1 that is necessary for sheet cutter 42 to cut one of printed media sheets (SH1 to SH3) and the time period necessary for sheet transporter 46 to insert each of the insertion sheets (IS1 to IS3) between cut media sheets (SH11 and SH12, SH21 and SH22, or SH31 and SH32; please see the insertion positions in FIG. 13A), as illustrated in FIG. 13B. The time period necessary for the sheet insertion is the sum of second time period T2' that is necessary for sheet transporter 46 to transport the end part of the cut media sheets (in this case, the end cut media sheet) along the sheet path into sheet buffer 43, third time period T3' necessary for sheet transporter 46 to return the end part of the cut media sheets from sheet buffer 43 into the sheet path, and fourth time period T4 indicating the interval of the cut media sheets (the interval at which sheet transporter 46 transports the cut media sheets).

Figure 14A:
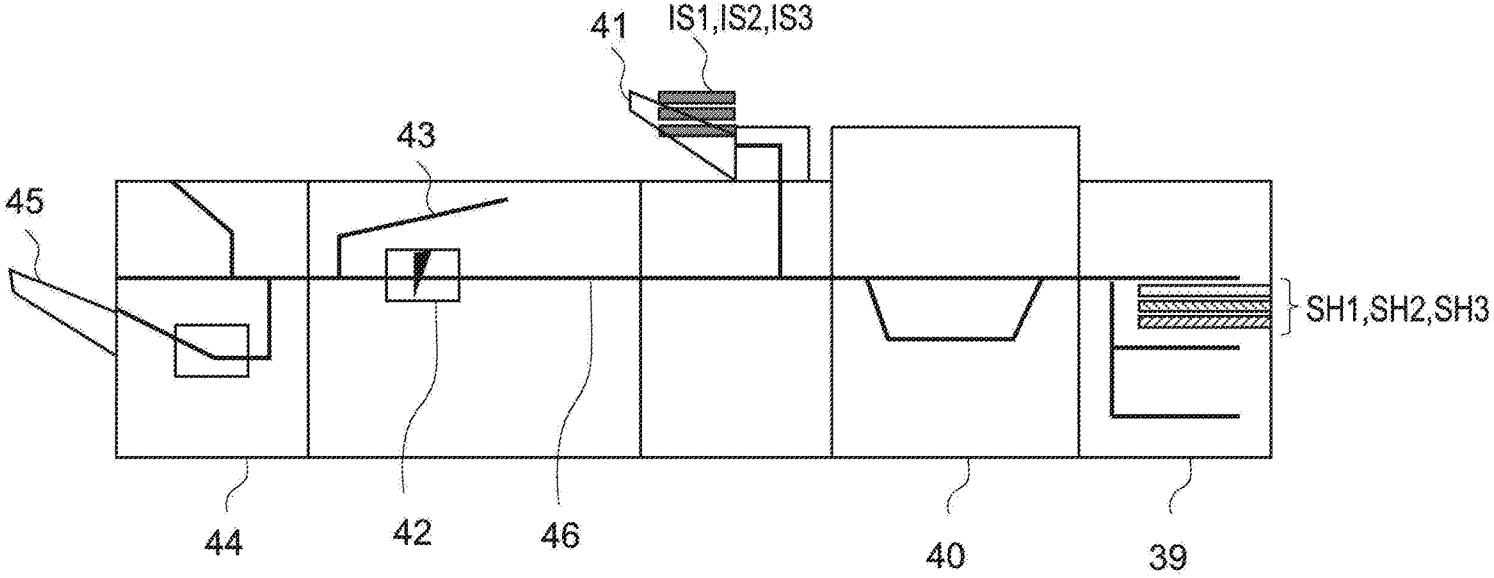
FIGS. 14A to 14E are schematic diagrams illustrating the way to control the media sheet transportation in the post-sheet insertion mode, according to the present embodiment.
Figure 14B:
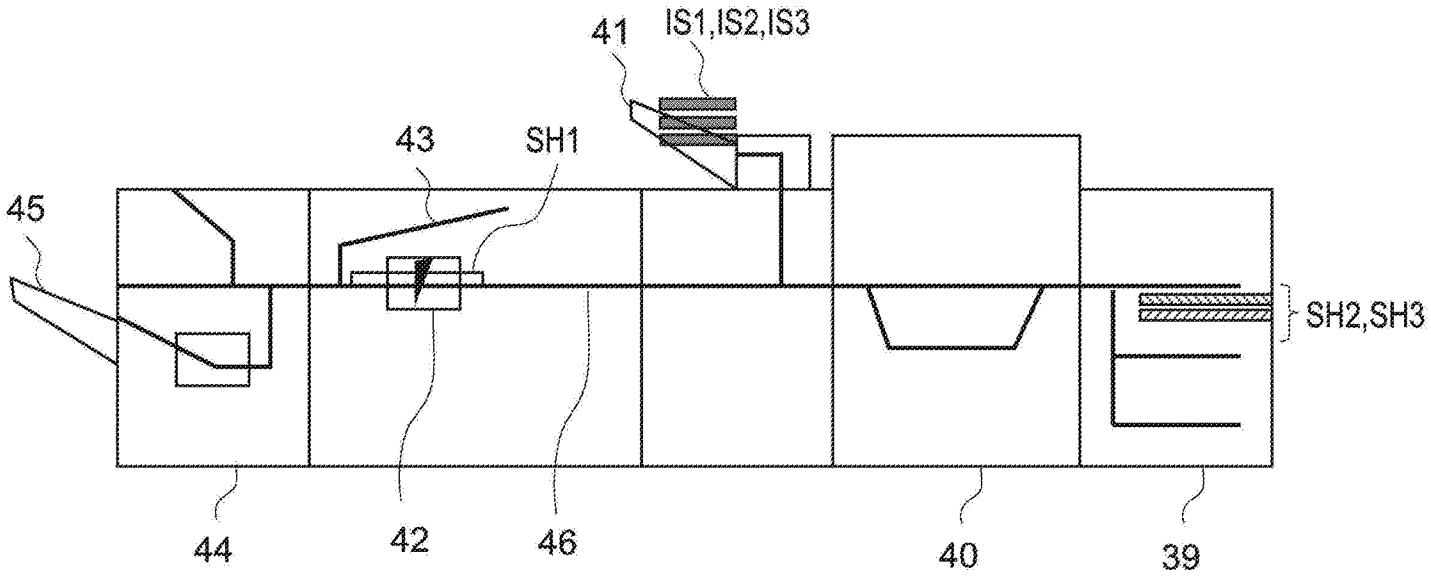
Figure 14C:
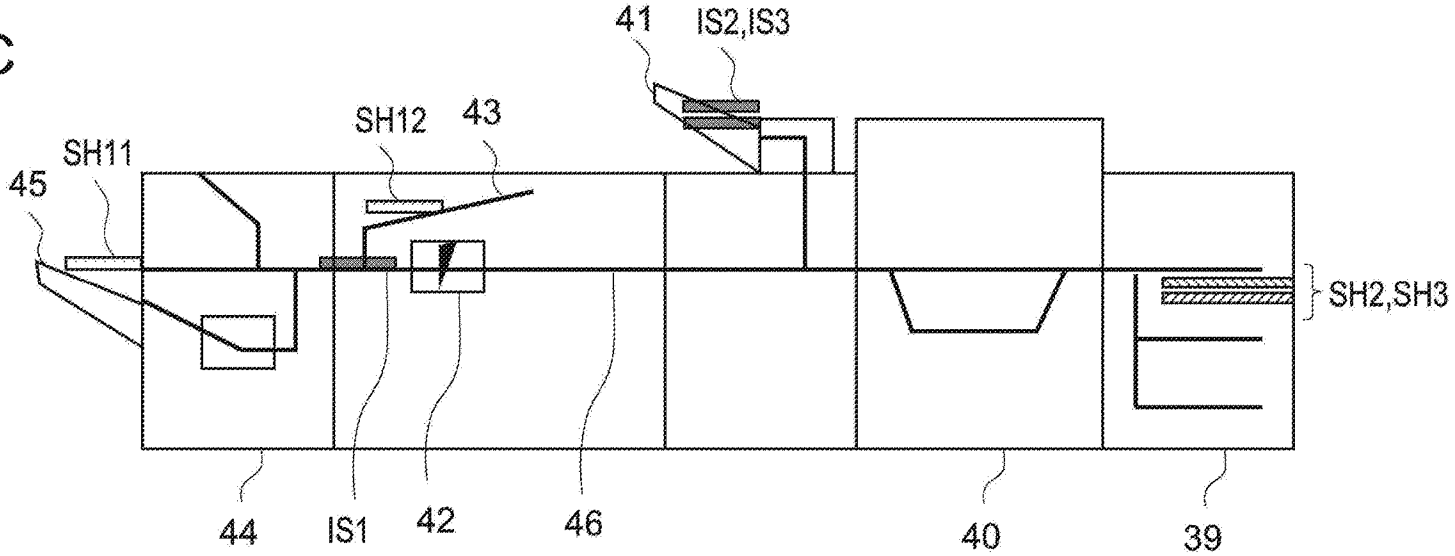
Figure 14D:
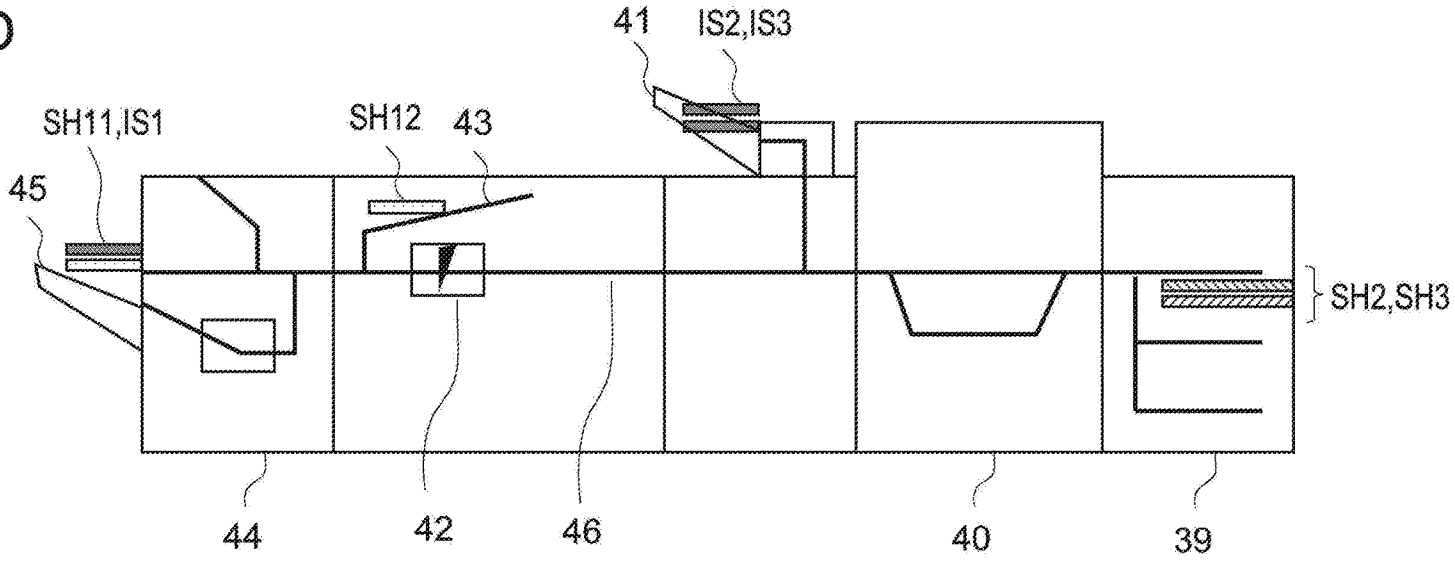
Figure 14E:
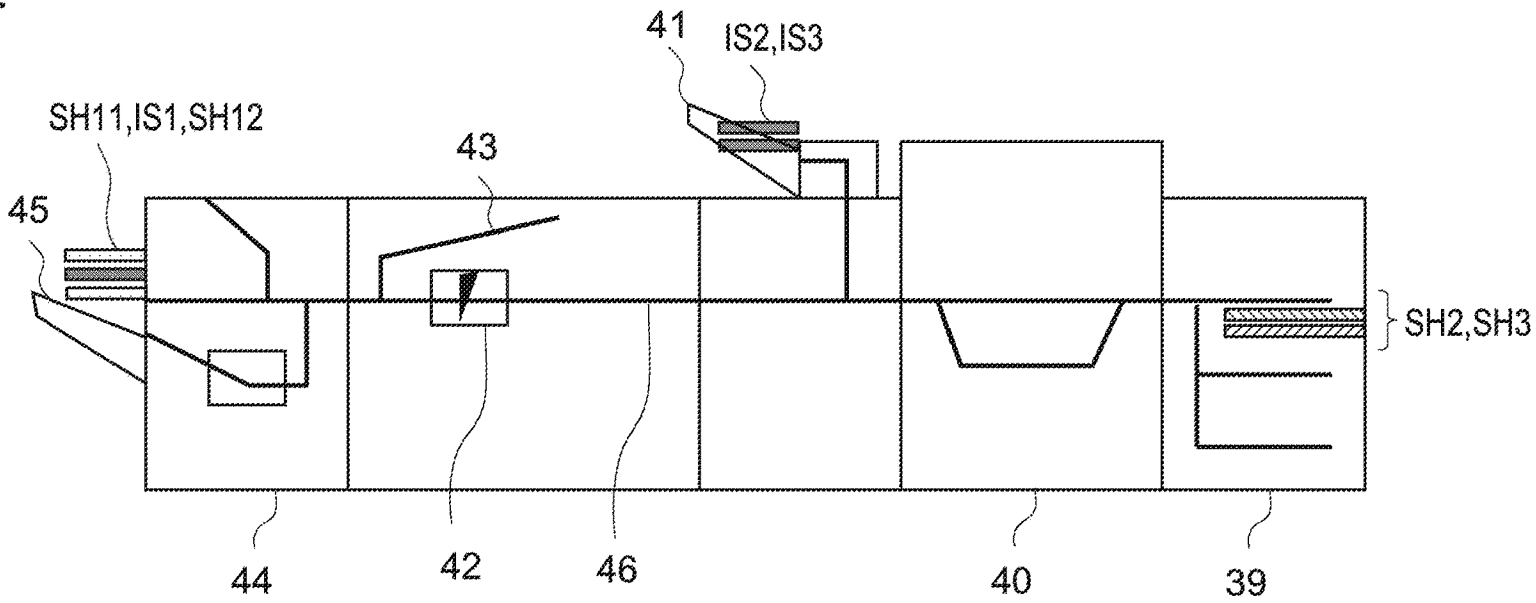

FIGS. 14A to 14E are schematic diagrams illustrating an example of the way to control the media sheet transportation in the post-sheet insertion mode. The media sheet transportation in the post-sheet insertion mode starts at the condition illustrated in FIG. 14A, such that three media sheets (SH1 to SH3) are stored in sheet feeder 39 and three insertion sheets (IS1 to IS3) are loaded on sheet inserter 41, and results in that the insertion sheets are put between cut media sheets given by a division of respective media sheets. First, sheet transporter 46, as illustrated in FIG. 14B, puts the first media sheet (SH1) from sheet feeder 39 into the sheet path and transports the sheet to printing unit 40. After printing unit 40 performs print processing on the first media sheet, sheet cutter 42 divides the first media sheet into two cut media sheets (SH11 and SH12) by cutting. Next, as illustrated in FIG. 14C, sheet transporter 46 transports the leading cut media sheet (SH11) to sheet stacker 45, and transports the end cut media sheets (SH12) to be put into sheet buffer 43. After that, sheet transporter 46 puts one insertion sheet (IS1) into the sheet path. Next, as illustrated in FIG. 14D, sheet transporter 46 transports the insertion sheet along the sheet path so that the insertion sheets passes through sheet cutter 42 and goes to sheet stacker 45. After that, as illustrated in FIG. 14E, sheet transporter 46 returns the end cut media sheets (SH12) kept in sheet buffer 43 into the sheet path, and transports the end cut media sheets (SH12) to sheet stacker 45. By performing the control of the media sheet transportation for the remaining media sheets (SH2, SH3) and the remaining insertion sheets (IS2, IS3) in printing unit 30 similarly, a stack of sheets in which insertion sheets are put between cut media sheets is realized as illustrated in FIG. 12C.

Operations of Printing Device:

Hereinafter, a description is given of operations of printing device 30 according to the present embodiment in details. CPU32 of printing device 30 reads out the program for controlling transportation of media sheets, stored in ROM 33 or storage unit 35, loads the program onto RAM 34, and executes the program, thereby executing the steps of the flowcharts illustrated in FIGS. 15 to 18.

Figure 15:
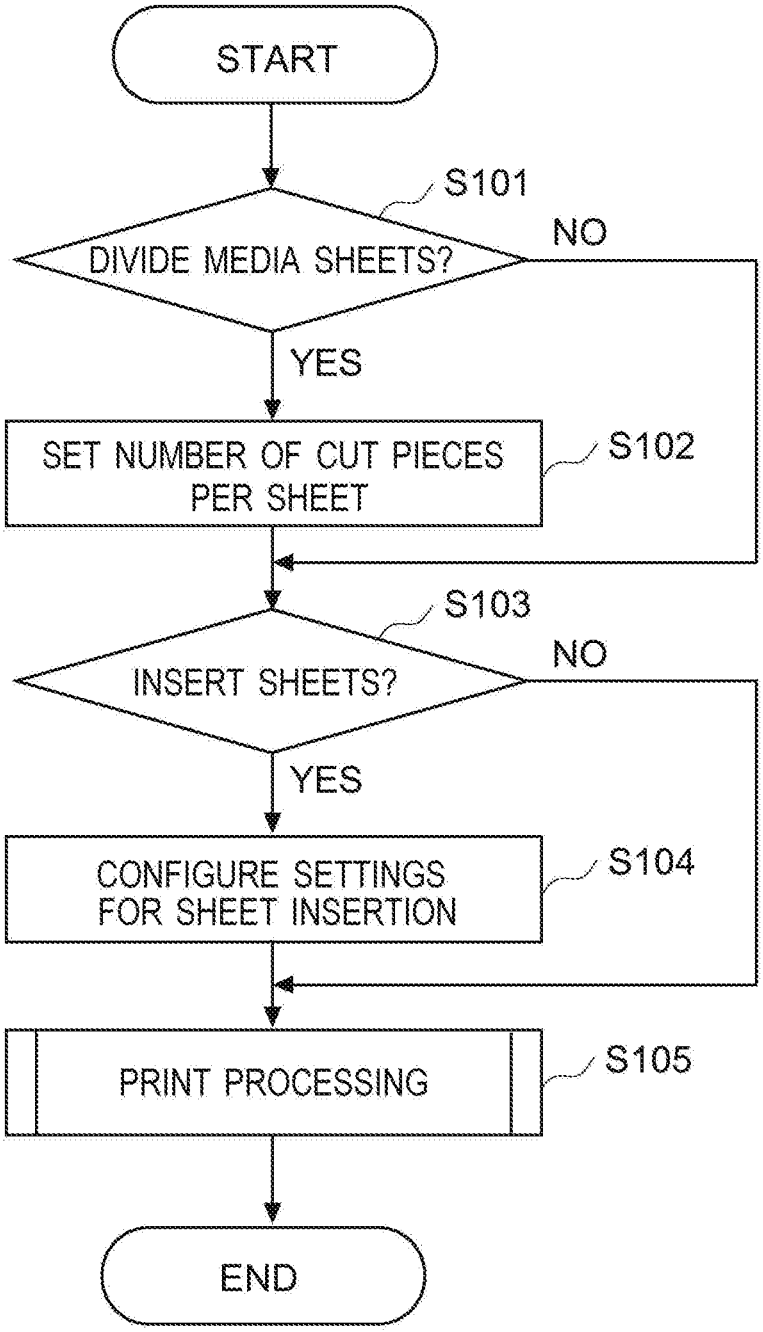
FIG. 15 is a flowchart illustrating an example of job-processing operations of the printing device, according to the present embodiment.

As illustrated in FIG. 15, built-in controller 31 (setting controller 31*a*) analyzes a print job, and checks print settings to judge whether a division of media sheets is specified (Step S101). Judging that a division of media sheets is specified (YES in Step S101), built-in controller 31 (setting controller 31*a*) sets the number of cut pieces (cut media sheets) to be made from one media sheets (Step S102). Next, built-in controller 31 (setting controller 31*a*) checks the print settings to judge whether a use of insertion sheets is specified (Step S103). Judging that a use of insertion sheets is specified (YES in Step S103), built-in controller 31 (setting controller 31*a*) configures settings about handling of insertion sheets according to the print settings (Step S104). After that, built-in controller 31 (sheet transportation controller 31*b*) causes printing unit 40 to perform print processing (Step S105).

FIG. 16 illustrates processes to control print processing and media sheet transportation in the pre-sheet insertion mode in details. Built-in controller 31 (sheet transportation controller 31*b*) judges whether a division of media sheets is specified (Step S201). Judging that a division of media sheets is specified (YES in Step S201), built-in controller 31 (sheet transportation controller 31*b*) further judges whether putting insertion sheets between cut media sheets is specified (Step S202). Judging that a division of media sheets is not specified (NO in Step S201), or judging that a division of media sheets is specified and that putting insertion sheets between cut media sheets is not specified (NO in Step S202), built-in controller 31 (sheet transportation controller 31*b*) causes printing unit 40 to perform ordinary print processing (Step S203).

On the other hand, judging that a division of media sheets is specified and that putting insertion sheets between cut media sheets is specified (YES in Step S202), built-in controller 31 (sheet transportation controller 31*b*) controls sheet transporter 46 to feed an insertion sheet from sheet inserter 41 into the sheet path as a starter and transport the insertion sheet into sheet buffer 43 (Step S204). Next, built-in controller 31 (sheet transportation controller 31*b*) controls sheet transporter 46 to feed a media sheet from sheet feeder 39 into the sheet path and transport the media sheet to printing unit 40, and printing unit 40 performs print processing on the media sheet. Sheet cutter 42 then divides the printed media sheet into cut pieces (cut media sheets) by cutting (Step S205). Next, built-in controller 31 (sheet transportation controller 31*b*) controls sheet transporter 46 to start transporting a leading part of the cut media sheets (one or more sheets among the cut media sheets, located upstream of the other cut media sheet or sheets in the sheet path) along the sheet path (Step S206), and judges whether the leading part of the cut media sheets has passed through the branch position on the sheet path at which the sheet path branches off to sheet buffer 43 (Step S207). Judging that the leading part of the cut media sheets has passed through the branch position (YES in Step S207), built-in controller 31 (sheet transportation controller 31*b*) controls sheet transporter 46 to return the insertion sheet kept in sheet buffer 43 to the sheet path through the branch position (Step S208), and start transporting a succeeding part of the cut media sheets (one or more sheets among the cut media sheets, located downstream of the leading part of the cut media sheets in the sheet path) along the sheet path (Step S209).

After that, built-in controller 31 (sheet transportation controller 31*b*) judges whether a next media sheet remains in sheet feeder 39 (Step S210). Judging that no media sheet remains in sheet feeder 39 (NO in Step S210), built-in controller 31 (sheet transportation controller 31*b*) ends the media sheet transportation. Judging that a next media sheet remains in sheet feeder 39 (YES in Step S210), built-in controller 31 (sheet transportation controller 31*b*) judges whether the sheet-feeding interval has elapsed from the time when the prior media sheet was fed into the sheet path (Step S211). Judging that the sheet-feeding interval has elapsed (YES in Step S211), built-in controller 31 (sheet transportation controller 31*b*) returns to Step S204 to execute succeeding processes similarly on the next media sheet.

Figure 17:
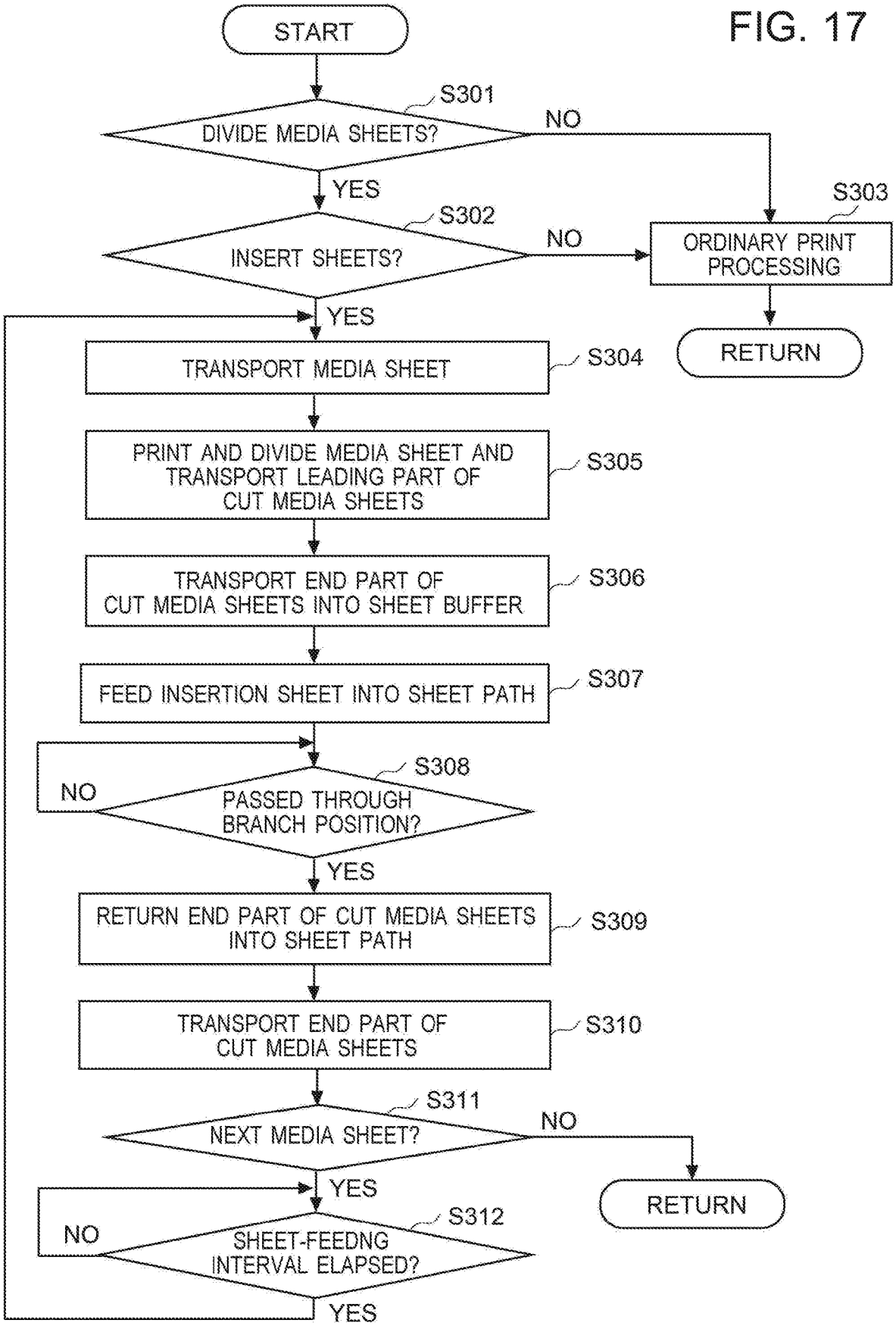
FIG. 17 is a flowchart illustrating an example of operations (control of print processing and media sheet transportation in the post-sheet insertion mode) of the printing device, according to the present embodiment.

FIG. 17 illustrates processes to control print processing and media sheet transportation in the post-sheet insertion mode in details. Built-in controller 31 (sheet transportation controller 31*b*) judges whether a division of media sheets is specified (Step S301). Judging that a division of media sheets is specified (YES in Step S301), built-in controller 31 (sheet transportation controller 31*b*) further judges whether putting insertion sheets between cut media sheets is specified (Step S302). Judging that a division of media sheets is not specified (NO in Step S301), or judging that a division of media sheets is specified and that putting insertion sheets between cut media sheets is not specified (NO in Step S302), built-in controller 31 (sheet transportation controller 31*b*) causes printing unit 40 to perform ordinary print processing (Step S303).

On the other hand, judging that a division of media sheets is specified and that putting insertion sheets between cut media sheets is specified (YES in Step S302), built-in controller 31 (sheet transportation controller 31*b*) controls sheet transporter 46 to feed a media sheet from sheet feeder 39 into the sheet path as a starter and transport the media sheet to printing unit 40 (Step S304). Next, printing unit 40 performs print processing on the media sheet, and sheet cutter 42 then divides the printed media sheet into cut pieces (cut media sheets) by cutting. Built-in controller 31 (sheet transportation controller 31*b*) then controls sheet transporter 46 to start transporting a leading part of the cut media sheets (one or more sheets among the cut media sheets, located upstream of the other cut media sheet or sheets in the sheet path) along the sheet path (Step S305). Next, built-in controller 31 (sheet transportation controller 31*b*) controls sheet transporter 46 to transport the end part of the cut media sheets (one or more sheets among the cut media sheets, located downstream of the leading part of the cut media sheets in the sheet path) into sheet buffer 43 (Step S306), and feed an insertion sheet from sheet inserter 41 into the sheet path (Step S307). Next, built-in controller 31 (sheet transportation controller 31*b*) judges whether the insertion sheet has passed through the branch position on the sheet path at which the sheet path branches off to sheet buffer 43 (Step S308). Judging that the insertion sheet has passed through the branch position (YES in Step S308), built-in controller 31 (sheet transportation controller 31*b*) controls sheet transporter 46 to return the end part of the cut media sheets kept in sheet buffer 43 to the sheet path through the branch position (Step S309), and start transporting the end part of the cut media sheets along the sheet path (Step S310).

After that, built-in controller 31 (sheet transportation controller 31*b*) judges whether a next media sheet remains in sheet feeder 39 (Step S311). Judging that no media sheet remains in sheet feeder 39 (NO in Step S311), built-in controller 31 (sheet transportation controller 31*b*) ends the media sheet transportation. Judging that a next media sheet remains in sheet feeder 39 (YES in Step S311), built-in controller 31 (sheet transportation controller 31*b*) judges whether the sheet-feeding interval has elapsed from the time when the prior media sheet was fed into the sheet path (Step S312). Judging that the sheet-feeding interval has elapsed (YES in Step S312), built-in controller 31 (sheet transportation controller 31*b*) returns to Step 304 to execute succeeding processes similarly on the next media sheet.

Figure 18:
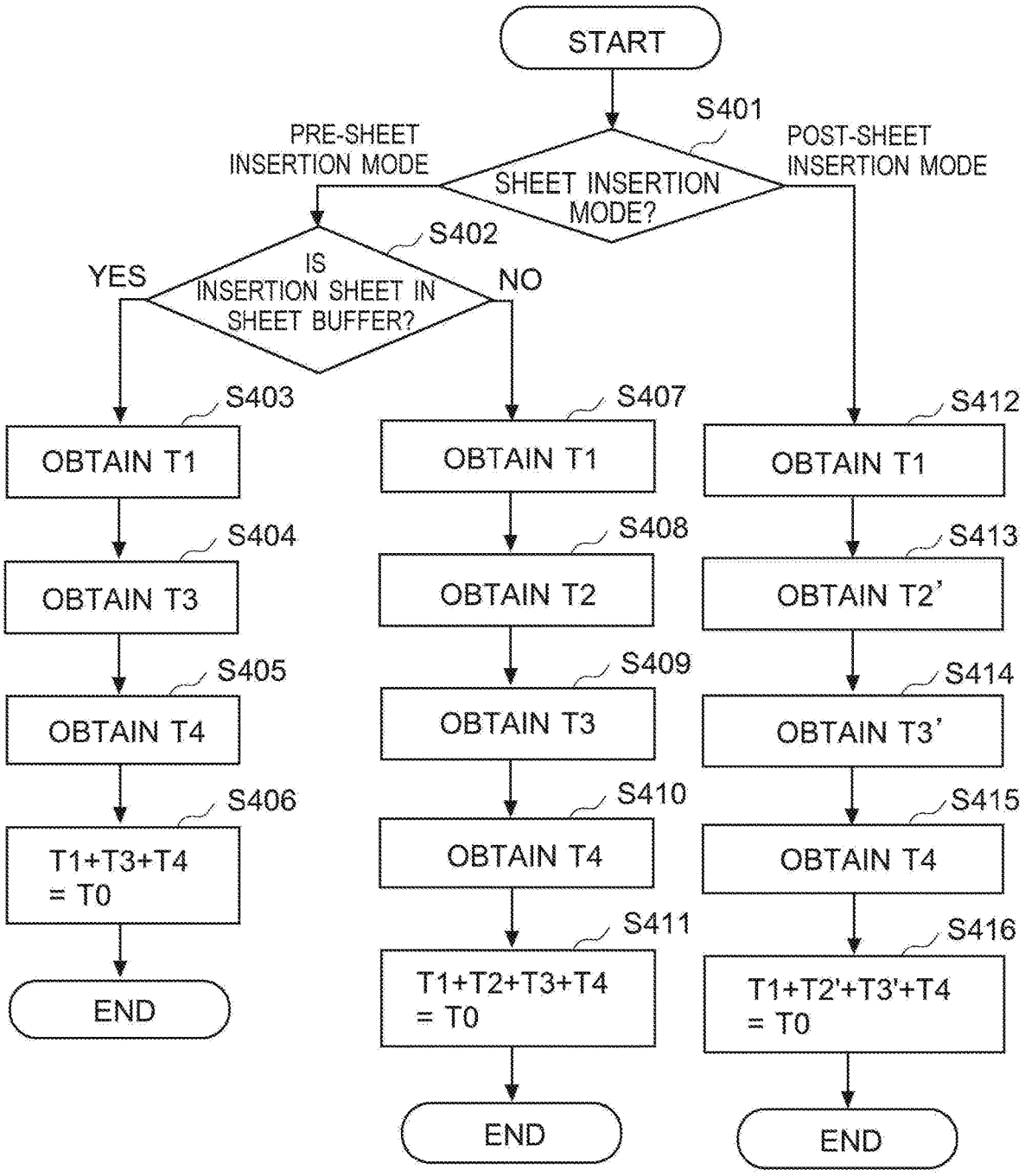
FIG. 18 is a flowchart illustrating an example of operations (calculation of the interval at which media sheets are to be fed to a sheet cutter) of the printing device, according to the present embodiment.

FIG. 18 is a flowchart illustrating calculation of the sheet-feeding interval for use in the judgement in the above-described Steps 211 and S312. First, built-in controller 31 (sheet-feeding interval calculator 31*c*) judges whether the sheet insertion mode is set to the pre-sheet insertion mode or the post-sheet insertion mode (Step S401). Judging that the sheet insertion mode is set to the pre-sheet insertion mode, built-in controller 31 (sheet-feeding interval calculator 31*c*) further judges whether an insertion sheet has already been transported and is kept in sheet buffer 43 (Step S402).

Judging that an insertion sheet has already been transported and is kept in sheet buffer 43 (YES in Step S402), built-in controller 31 (sheet-feeding interval calculator 31*c*) obtains from storage unit 35 the first time period T1 indicating the time period necessary for sheet cutter 42 to cut one of printed media sheets (Step S403). Next, built-in controller 31 (sheet-feeding interval calculator 31*c*) obtains third time period T3 indicating the time period necessary for sheet transporter 46 to return the insertion sheet from sheet buffer 43 into the sheet path (Step S404), and further obtains fourth time period T4 indicating the interval of cut media sheets (the interval at which sheet transporter 46 transports cut media sheets) (Step S405). Built-in controller 31 (sheet-feeding interval calculator 31*c*) then calculates the total sum of time periods T1, T3 and T4 to obtain the sheet-feeding interval T0 (Step S406).

Judging that an insertion sheet has not been transported and is not kept in sheet buffer 43 yet (NO in Step S402), built-in controller 31 (sheet-feeding interval calculator 31*c*) obtains from storage unit 35 the first time period T1 indicating the time period necessary for sheet cutter 42 to cut one of printed media sheets (Step S407). Next, built-in controller 31 (sheet-feeding interval calculator 31*c*) obtains second time period T2 indicating the time period necessary for sheet transporter 46 to transport an insertion sheet inserted into the sheet path by sheet inserter 39, into sheet buffer 43, and third time period T3 indicating the time period necessary for sheet transporter 46 to return the insertion sheet from sheet buffer 43 into the sheet path with sheet transporter 46 (Steps S408 and S409), and further obtains fourth time period T4 indicating the interval of cut media sheets (the interval at which sheet transporter 46 transports cut media sheets) (Step S410). Built-in controller 31 (sheet-feeding interval calculator 31*c*) then calculates the total sum of time periods T1, T2, T3 and T4 to obtain the sheet-feeding interval T0 (Step S411).

On the other hand, judging that the sheet insertion mode is set to the post-sheet insertion mode, built-in controller 31 (sheet-feeding interval calculator 31*c*) obtains from storage unit 35 the first time period T1 indicating the time period necessary for sheet cutter 42 to cut one of printed media sheets (Step S412). Next, built-in controller 31 (sheet-feeding interval calculator 31*c*) obtains second time period T2' indicating the time period necessary the sheet transporter 46 to transport an end part of the cut media sheets given by a division of one of the printed media sheets, along the sheet path into sheet buffer 43 and third time period T3' indicating the time period necessary for sheet transporter 46 to return the end part of the cut media sheets from sheet buffer 43 into the sheet path (Steps S413 and S414), and further obtains fourth time period T4 indicating the interval of cut media sheets (the interval at which sheet transporter 46 transports cut media sheets) (Step S415). Built-in controller 31 (sheet-feeding interval calculator 31*c*) then calculates the total sum of time periods T1, T2', T3' and T4 to obtain the sheet-feeding interval T0 (Step S416).

As described above, printing device 30 (or a device capable of dividing a media sheet into multiple cut media sheets by cutting and of putting an insertion sheet between the cut media sheets, like a finisher) includes sheet buffer 43 disposed downstream of sheet cutter 42, for leaving a sheet from the sheet path and keeping the sheet therein, and built-in controller 31 (sheet transportation controller 31*b*) of printing device 30 (or the built-in controller of the device) controls sheet transporter 46 to transport an insertion sheet or an end part of cut media sheets given by a division of a media sheet by cutting, into sheet buffer 43, so as to sort the media sheets in the sheet path. It allows printing device 30 (or the device) to put insertion sheet between cut media sheets and create a stack of cut media sheets and insertion sheets arranged in desired order.

It should be noted that the present invention should not be limited to the above-described embodiments, and the constitution and operations of the printing device and the system including the printing device can be modified appropriately, unless the modification deviates from the intention of the present invention.

For example, the above-described embodiment gave the operations to control of media sheet transportation in which each media sheet is cut into two pieces, but alternatively, the disclosed method for controlling transportation of media sheets is similarly applicable to operations to control media sheet transportation in which each media sheet is cut into three or more pieces.

For another example, the above-described embodiment gave operations to put insertion sheets between cut media sheets given by a division of all the media sheets fed from sheet feeder 39 by cutting, but alternatively, the disclosed method for controlling media sheet transportation is similarly applicable to operations to put insertion sheets between cut media sheets given by a division of one or more media sheets selected from the media sheets fed from sheet feeder 39 by cutting.

For another example, the above-described embodiment gave operations to put insertion sheets between only cut media sheets given by a division of media sheets, but alternatively, the disclosed method for controlling transportation of media sheets is similarly applicable to operations to put insertion sheets also between media sheets before cutting and/or between media sheets given by a division of different media sheets by cutting, additionally to between cut media sheets given by a division of each of media sheets by cutting.

The present invention is applicable to finishers capable of putting an insertion sheet between cut media sheets given by a division of a media sheet by cutting, programs for controlling transportation of media sheets, to be executed in the finisher, non-transitory computer-readable recording media each storing the program, and methods for controlling transportation of media sheets.

Although embodiments of the present invention have been described and illustrated in detail, it is clearly understood that the same is by way of illustration and example only and not limitation, the scope of the present invention should be interpreted by terms of the appended claims.

The invention claimed is:

1. A finisher comprising:

a sheet transporter that transports media sheets along a sheet path;

a sheet cutter that is disposed on the sheet path and that receives printed media sheets that were subjected to print processing by a print engine and divides each of the printed media sheets into two or more cut media sheets that lie in the sheet path, by cutting each of the printed media sheets in a direction crossing the sheet path;

a sheet inserter that inserts insertion sheets not to be subjected to print processing, into the sheet path;

a sheet stacker that stacks the cut media sheets and the insertion sheets transported by the sheet transporter thereon;

a sheet buffer that is disposed on a branch line branching off from the sheet path at a branch position on the sheet path between the sheet cutter and the sheet stacker; and a controller that controls transportation of media sheets with the sheet transporter, wherein the controller performs operations, including:

setting a sheet insertion mode to one of a pre-sheet insertion mode and a post-sheet insertion mode, where the sheet insertion mode is a mode for use in inserting an insertion sheet to be put between cut media sheets given by a division of one of the printed media sheets, into the sheet path by the sheet inserter, the pre-sheet insertion mode is a mode in which the insertion sheet is inserted into the sheet path so that the insertion sheet passes through the sheet cutter before the sheet cutter divides the one of the printed media sheets, and the post-sheet insertion mode is a mode in which the insertion sheet is inserted into the sheet path so that the insertion sheet passes through the sheet cutter after the sheet cutter divides the one of the printed media sheets, and according to the sheet insertion mode, controlling transportation of cut media sheets given by a division of one of the printed media sheets with the sheet cutter and an insertion sheet inserted into the sheet path by the sheet inserter, by causing the sheet transporter to transport either of a part of the cut media sheets and the insertion sheet into the sheet buffer and change an order of the cut media sheets and the insertion sheet being transported along the sheet path so that the insertion sheet is positioned between the cut media sheets.

2. The finisher of claim 1, wherein the controlling includes, under a condition that the sheet insertion mode is set to the pre-sheet insertion mode, causing the sheet transporter to transport the insertion sheet into the sheet buffer and transpose one or more leading cut media sheets among the cut media sheets and the insertion sheet being transported along the sheet path so that the insertion sheet is positioned between the cut media sheets.

3. The finisher of claim 2, wherein the controlling includes causing the sheet transporter to perform operations including:

first transporting the insertion sheet along the sheet path into the sheet buffer, second transporting the one or more leading cut media sheets along the sheet path, after the first transporting, returning the insertion sheet in the sheet buffer into the sheet path and third transporting the insertion sheet along the sheet path, after the one or more leading cut media sheets pass through the branch position on the sheet path in the second transporting, and fourth transporting one or more succeeding cut media sheets following the one or more leading cut media sheets among the cut media sheets, along the sheet path, after the third transporting.

4. The finisher of claim 1, wherein the controlling includes, under a condition that the sheet insertion mode is set to the post-sheet insertion mode, causing the sheet transporter to transport one or more end cut media sheets among the cut media sheets into the sheet buffer and transpose the one or more end cut media sheets and the insertion sheet being transported along the sheet path so that the insertion sheet is positioned between the cut media sheets.

5. The finisher of claim 4, wherein the controlling includes causing the sheet transporter to perform operations including:

first transporting one or more leading cut media sheets leading the one or more end cut media sheets among the cut media sheets, along the sheet path, second transporting the one or more end cut media sheets along the sheet path into the sheet buffer, after the first transporting, third transporting the insertion sheet along the sheet path, after the second transporting, and returning the one or more end cut media sheets in the sheet buffer into the sheet path and fourth transporting the one or more end cut media sheets along the sheet path, after the insertion sheet passes through the branch position on the sheet path in the third transporting.

6. The finisher of claim 1, wherein the operations further include:

calculating an interval at which the sheet transporter feeds the printed media sheets to the sheet cutter, and causing the sheet transporter to feed the printed media sheets to the sheet cutter at the interval.

7. The finisher of claim 6, wherein the calculating includes calculating the interval by using:

a time period necessary for the sheet cutter to cut one of the printed media sheets, a time period necessary for the sheet transporter to transport either of an insertion sheet inserted into the sheet path by the sheet inserter and one or more end cut media sheets among cut media sheets given by a division of one of the printed media sheets with the sheet cutter, along the sheet path into the sheet buffer, a time period necessary for the sheet transporter to return the either of the insertion sheet and the one or more end cut media sheets from the sheet buffer into the sheet path, and an interval at which the sheet transporter transports the cut media sheets.

8. A non-transitory computer-readable recording medium storing a program for controlling transportation of media sheets, to be executed in a finisher, the finisher including: (i) a sheet transporter that transports media sheets along a sheet path; (ii) a sheet cutter that is disposed on the sheet path and that receives printed media sheets that were subjected to print processing by a print engine and divides each of the printed media sheets into two or more cut media sheets that line lie in the sheet path, by cutting each of the printed media sheets in a direction crossing the sheet path; (iii) a sheet inserter that inserts insertion sheets not to be subjected to print processing, into the sheet path; (iv) a sheet stacker that stacks the cut media sheets and the insertion sheets transported by the sheet transporter thereon; (v) a sheet buffer that is disposed on a branch line branching off from the sheet path at a branch position on the sheet path between the sheet cutter and the sheet stacker; and (vi) a controller that controls transportation of media sheets with the sheet transporter, the program comprising instructions that are executable by the controller to cause the controller to perform operations comprising:

setting a sheet insertion mode to one of a pre-sheet insertion mode and a post-sheet insertion mode, where the sheet insertion mode is a mode for use in inserting an insertion sheet to be put between cut media sheets given by a division of one of the printed media sheets, into the sheet path by the sheet inserter, the pre-sheet insertion mode is a mode in which the insertion sheet is inserted into the sheet path so that the insertion sheet passes through the sheet cutter before the sheet cutter divides the one of the printed media sheets, and the post-sheet insertion mode is a mode in which the insertion sheet is inserted into the sheet path so that the insertion sheet passes through the sheet cutter after the sheet cutter divides the one of the printed media sheets; and according to the sheet insertion mode, controlling transportation of cut media sheets given by a division of one of the printed media sheets with the sheet cutter and an insertion sheet inserted into the sheet path by the sheet inserter, by causing the sheet transporter to transport either of a part of the cut media sheets and the insertion sheet into the sheet buffer and change an order of the cut media sheets and the insertion sheet being transported along the sheet path so that the insertion sheet is positioned between the cut media sheets.

9. The non-transitory computer-readable recording medium of claim 8, wherein the controlling includes, under a condition that the sheet insertion mode is set to the pre-sheet insertion mode, causing the sheet transporter to transport the insertion sheet into the sheet buffer and transpose one or more leading cut media sheets among the cut media sheets and the insertion sheet being transported along the sheet path so that the insertion sheet is positioned between the cut media sheets.

10. The non-transitory computer-readable recording medium of claim 9, wherein the controlling includes causing the sheet transporter to perform operations including:

first transporting the insertion sheet along the sheet path into the sheet buffer, second transporting the one or more leading cut media sheets along the sheet path, after the first transporting, returning the insertion sheet in the sheet buffer into the sheet path and third transporting the insertion sheet along the sheet path, after the one or more leading cut media sheets pass through the branch position on the sheet path in the second transporting, and fourth transporting one or more succeeding cut media sheets following the one or more leading cut media sheets among the cut media sheets, along the sheet path, after the third transporting.

11. The non-transitory computer-readable recording medium of claim 8, wherein the controlling includes, under a condition that the sheet insertion mode is set to the post-sheet insertion mode, causing the sheet transporter to transport one or more end cut media sheets among the cut media sheets into the sheet buffer and transpose the one or more end cut media sheets and the insertion sheet being transported along the sheet path so that the insertion sheet is positioned between the cut media sheets.

12. The non-transitory computer-readable recording medium of claim 11, wherein the controlling includes causing the sheet transporter to perform operations including:

first transporting one or more leading cut media sheets leading the one or more end cut media sheets among the cut media sheets, along the sheet path, second transporting the one or more end cut media sheets along the sheet path into the sheet buffer, after the first transporting, third transporting the insertion sheet along the sheet path, after the second transporting, and returning the one or more end cut media sheets in the sheet buffer into the sheet path and fourth transporting the one or more end cut media sheets along the sheet path, after the insertion sheet passes through the branch position on the sheet path in the third transporting.

13. The non-transitory computer-readable recording medium of claim 8, wherein the operations further include:

calculating an interval at which the sheet transporter feeds the printed media sheets to the sheet cutter, and causing the sheet transporter to feed the printed media sheets to the sheet cutter at the interval.

14. The non-transitory computer-readable recording medium of claim 13, wherein the calculating includes calculating the interval by using:

a time period necessary for the sheet cutter to cut one of the printed media sheets, a time period necessary for the sheet transporter to transport either of an insertion sheet inserted into the sheet path by the sheet inserter and one or more end cut media sheets among cut media sheets given by a division of one of the printed media sheets with the sheet cutter, along the sheet path into the sheet buffer, a time period necessary for the sheet transporter to return the either of the insertion sheet and the one or more end cut media sheets from the sheet buffer into the sheet path, and an interval at which the sheet transporter transports the cut media sheets.

15. A method for controlling transportation of media sheets, for use in a finisher including: (i) a sheet transporter that transports media sheets along a sheet path; (ii) a sheet cutter that is disposed on the sheet path and that receives printed media sheets that were subjected to print processing by a print engine and divides each of the printed media sheets into two or more cut media sheets that lie in the sheet path, by cutting each of the printed media sheets in a direction crossing the sheet path; (iii) a sheet inserter that inserts insertion sheets not to be subjected to print processing, into the sheet path; (iv) a sheet stacker that stacks the cut media sheets and the insertion sheets transported by the sheet transporter thereon; (v) a sheet buffer that is disposed on a branch line branching off from the sheet path at a branch position on the sheet path between the sheet cutter and the sheet stacker; and (vi) a controller that controls transportation of media sheets with the sheet transporter, the method comprising:

setting, by the controller, a sheet insertion mode to one of a pre-sheet insertion mode and a post-sheet insertion mode, where the sheet insertion mode is a mode for use in inserting an insertion sheet to be put between cut media sheets given by a division of one of the printed media sheets, into the sheet path by the sheet inserter, the pre-sheet insertion mode is a mode in which the insertion sheet is inserted into the sheet path so that the insertion sheet passes through the sheet cutter before the sheet cutter divides the one of the printed media sheets, and the post-sheet insertion mode is a mode in which the insertion sheet is inserted into the sheet path so that the insertion sheet passes through the sheet cutter after the sheet cutter divides the one of the printed media sheets; and according to the sheet insertion mode, controlling, by the controller, transportation of cut media sheets given by a division of one of the printed media sheets with the sheet cutter and an insertion sheet inserted into the sheet path by the sheet inserter, by causing the sheet transporter to transport either of a part of the cut media sheets and the insertion sheet into the sheet buffer and change an order of the cut media sheets and the insertion sheet being transported along the sheet path so that the insertion sheet is positioned between the cut media sheets.

16. The method of claim 15, wherein the controlling includes, under a condition that the sheet insertion mode is set to the pre-sheet insertion mode, causing the sheet transporter to transport the insertion sheet into the sheet buffer and transpose one or more leading cut media sheets among the cut media sheets and the insertion sheet being transported along the sheet path so that the insertion sheet is positioned between the cut media sheets.

17. The method of claim 16, wherein the controlling includes causing the sheet transporter to perform operations including:

first transporting the insertion sheet along the sheet path into the sheet buffer, second transporting the one or more leading cut media sheets along the sheet path, after the first transporting, returning the insertion sheet in the sheet buffer into the sheet path and third transporting the insertion sheet along the sheet path, after the one or more leading cut media sheets pass through the branch position on the sheet path in the second transporting, and fourth transporting one or more succeeding cut media sheets following the one or more leading cut media sheets among the cut media sheets, along the sheet path, after the third transporting.

18. The method of claim 15, wherein the controlling includes, under a condition that the sheet insertion mode is set to the post-sheet insertion mode, causing the sheet transporter to transport one or more end cut media sheets among the cut media sheets into the sheet buffer and transpose the one or more end cut media sheets and the insertion sheet being transported along the sheet path so that the insertion sheet is positioned between the cut media sheets.

19. The method of claim 18, wherein the controlling includes causing the sheet transporter to perform operations including:

first transporting one or more leading cut media sheets leading the one or more end cut media sheets among the cut media sheets, along the sheet path, second transporting the one or more end cut media sheets along the sheet path into the sheet buffer, after the first transporting, third transporting the insertion sheet along the sheet path, after the second transporting, and returning the one or more end cut media sheets in the sheet buffer into the sheet path and fourth transporting the one or more end cut media sheets along the sheet path, after the insertion sheet passes through the branch position on the sheet path in the third transporting.

20. The method of claim 15, further comprising:

calculating an interval at which the sheet transporter feeds the printed media sheets to the sheet cutter, and causing the sheet transporter to feed the printed media sheets to the sheet cutter at the interval.

21. The method of claim 20, wherein the calculating includes calculating the interval by using:

a time period necessary for the sheet cutter to cut one of the printed media sheets, a time period necessary for the sheet transporter to transport either of an insertion sheet inserted into the sheet path by the sheet inserter and one or more end cut media sheets among cut media sheets given by a division of one of the printed media sheets with the sheet cutter, along the sheet path into the sheet buffer, a time period necessary for the sheet transporter to return the either of the insertion sheet and the one or more end cut media sheets from the sheet buffer into the sheet path, and an interval at which the sheet transporter transports the cut media sheets.

* * * * *